US007247105B2

(12) United States Patent
Huntsberger

(10) Patent No.: US 7,247,105 B2
(45) Date of Patent: Jul. 24, 2007

(54) CONVERTIBLE GAME APPARATUS

(75) Inventor: Kurt J. Huntsberger, Chaffee, NY (US)

(73) Assignee: Mattel, Inc., El Segundo, CA (US)

( * ) Notice: Subject to any disclaimer, the term of this patent is extended or adjusted under 35 U.S.C. 154(b) by 181 days.

(21) Appl. No.: 11/032,221

(22) Filed: Jan. 11, 2005

(65) Prior Publication Data

US 2006/0154751 A1 Jul. 13, 2006

(51) Int. Cl.
*A63B 67/00* (2006.01)
*A63B 69/00* (2006.01)

(52) U.S. Cl. ..... 473/433; 473/447; 473/479; 473/478

(58) Field of Classification Search ..... 473/422, 473/432–435, 447–449, 472, 479–489, 416; 434/247, 248; 273/317.3
See application file for complete search history.

(56) References Cited

U.S. PATENT DOCUMENTS

| | | | | |
|---|---|---|---|---|
| D213,209 | S | 1/1969 | Zielinkski | |
| 4,226,416 | A * | 10/1980 | Callanan | 473/448 |
| 4,239,235 | A | 12/1980 | Torres | |
| 4,245,843 | A | 1/1981 | Griggs | |
| 4,489,941 | A | 12/1984 | Shieh | |
| 4,703,931 | A | 11/1987 | Steen | |
| 4,762,319 | A | 8/1988 | Krumholz | |
| 4,786,053 | A * | 11/1988 | Barnes, Jr. | 473/416 |
| 4,786,371 | A | 11/1988 | Postol | |
| 4,826,166 | A | 5/1989 | Baker et al. | |
| 4,838,549 | A | 6/1989 | Woodall | |
| 4,842,283 | A | 6/1989 | LeBel et al. | |
| 4,858,920 | A | 8/1989 | Best | |
| 4,869,502 | A * | 9/1989 | Wares | 473/433 |
| D303,824 | S | 10/1989 | Maloney, II | |
| 4,932,657 | A | 6/1990 | Hailer et al. | |
| 4,940,232 | A * | 7/1990 | Chen | 473/416 |
| 4,956,775 | A | 9/1990 | Klamer et al. | |
| D315,383 | S | 3/1991 | Cochran et al. | |
| 5,000,461 | A | 3/1991 | Borazjani | |
| 5,037,095 | A | 8/1991 | Nedwick | |
| 5,060,940 | A * | 10/1991 | Mullen | 473/435 |
| D321,737 | S | 11/1991 | Lo | |
| D326,128 | S | 5/1992 | Smith | |
| 5,133,546 | A | 7/1992 | Matherne et al. | |
| 5,217,230 | A | 6/1993 | Judd | |
| 5,246,225 | A | 9/1993 | Matherne et al. | |
| 5,271,616 | A | 12/1993 | Grimaldi | |
| 5,294,913 | A | 3/1994 | Mower et al. | |
| 5,312,099 | A | 5/1994 | Oliver, Sr. | |
| 5,333,856 | A | 8/1994 | Gery | |
| 5,354,052 | A | 10/1994 | Nicholls et al. | |

(Continued)

FOREIGN PATENT DOCUMENTS

| | | |
|---|---|---|
| JP | 09-075490 | 3/1997 |

*Primary Examiner*—Mitra Aryanpour
(74) *Attorney, Agent, or Firm*—Edell, Shapiro & Finnan LLC

(57) ABSTRACT

A reconfigurable multi-sport, game apparatus is disclosed. The reconfigurable multi-sport, game apparatus includes multiple, separate target portions and a ball return portion. The multi-sport, game apparatus a basketball basket, a first target portion configured to receive a first sports implement thrown by a user, and a second target portion configured to receive a second sports implement propelled along the supporting surface by a user.

26 Claims, 37 Drawing Sheets

U.S. PATENT DOCUMENTS 5,418,517 A 5/1995 Matherne et al.
5,431,411 A 7/1995 Padilla
5,443,259 A 8/1995 Segan et al.
5,509,650 A 4/1996 MacDonald
5,513,843 A 5/1996 Russell
5,527,032 A 6/1996 Coleman et al.
5,553,848 A 9/1996 Amron
5,558,338 A * 9/1996 Taub ..... 473/416
5,584,480 A 12/1996 Grimsrud
5,613,676 A * 3/1997 Connolly ..... 473/416
5,613,922 A 3/1997 Hsiang
5,628,515 A 5/1997 Levy
5,630,760 A 5/1997 Brown et al.
5,678,824 A 10/1997 Fortier et al.
5,690,565 A 11/1997 Swanson
5,692,976 A 12/1997 Yu
5,816,947 A 10/1998 Kavitch
5,816,954 A 10/1998 Zheng
5,865,691 A 2/1999 Chen
6,030,300 A 2/2000 Zheng
6,056,652 A 5/2000 Lees et al.
6,068,488 A 5/2000 Sinsheimer et al.
6,082,736 A 7/2000 Barlow
6,149,152 A 11/2000 Mancke
6,155,939 A 12/2000 Takacs
6,192,635 B1 2/2001 Zheng
6,224,504 B1 5/2001 Tien
6,264,573 B1 7/2001 Zheng
6,267,696 B1 * 7/2001 Mabe et al. ..... 473/433
6,348,028 B1 * 2/2002 Cragg ..... 482/148
6,349,939 B1 2/2002 Tsai
6,379,272 B1 4/2002 Gorgo et al.
6,402,641 B1 6/2002 Lee
6,418,179 B1 7/2002 Shieh
6,458,049 B2 * 10/2002 Bush ..... 473/433
6,502,819 B2 1/2003 Reiber
6,551,205 B1 4/2003 Koelzer, Jr. et al.
6,554,724 B2 4/2003 Taylor
6,565,460 B2 5/2003 Wang
6,582,329 B1 6/2003 Cabrera
6,620,064 B2 9/2003 Nickerson
6,913,551 B1 * 7/2005 Foley ..... 473/448
6,929,569 B1 * 8/2005 Wang ..... 473/433
7,056,237 B2 * 6/2006 Slavey et al. ..... 473/433
2001/0006074 A1 7/2001 Zheng
2001/0055993 A1 12/2001 Diamant
2002/0032085 A1 3/2002 Zheng
2002/0068650 A1 6/2002 Wang
2002/0107092 A1 8/2002 Gottlieb-Meyers et al.
2003/0030218 A1 * 2/2003 Zucchi et al. ..... 273/371
2003/0060309 A1 3/2003 Smith, IV
2003/0125121 A1 7/2003 Rhee
2003/0153413 A1 8/2003 Wood et al.
2004/0058756 A1 * 3/2004 Huang ..... 473/433
2005/0085320 A1 * 4/2005 Joseph et al. ..... 473/433
2005/0101417 A1 * 5/2005 Hamons et al. ..... 473/415
2006/0040770 A1 * 2/2006 Chou ..... 473/433
2006/0154751 A1 * 7/2006 Huntsberger ..... 473/433

* cited by examiner

CONVERTIBLE GAME APPARATUS

FIELD OF THE INVENTION

To present invention relates to convertible, multi-sport, game apparatus and, more particularly, to a reconfigurable sports game apparatus including multiple, separate target portions and a return portion.

BACKGROUND

Children can develop motor skills and game playing skills through the use of a sports game apparatus. Typical apparatuses are used in the outdoors (e.g., in a backyard or on a playground) and include a netted stand at which a child can throw, kick, or bat a ball, wherein the net retains the ball within the playing area. Portable basketball goals are also available. These apparatuses, however, are usually constructed for a particular, single sports activity (baseball or basketball). Consequently, when a child is interested in playing several sports game activities, several apparatuses are required.

Some multi-sport game apparatuses have been proposed, but they often involve separate, removable parts, which are easily lost when not in use. In addition, multi-sport apparatuses have been proposed that are limited in their utility (providing only two sport activities) or are complicated to use. The availability of an easily-handled, easily-assembled, easily-adjusted, multi-sport game apparatus is an important factor in stimulating the development of the child's interest and skill in more than one sport (since the more entertaining an apparatus is to a child, the more the child will interact with the apparatus). There is, therefore, a continuing need for a multi-purpose, sports game apparatus that is readily convertible, can be easily used when desired for various sports gaming activities, and is beneficial in developing motor skills and coordination in a growing child. There is also a need for a multi-purpose, sports game apparatus that is of a relatively inexpensive, yet sturdy, construction and can be easily assembled, handled, adjusted, and reconfigured.

The present invention is directed generally to a sports game apparatus adapted to convert from a storage mode to multiple deployed modes and, in particular, to a reconfigurable, multi-sport, game apparatus including multiple, separate target portions, a return portion, and multiple sport game configurations.

SUMMARY

The present invention is directed toward a reconfigurable multi-sport, game apparatus including multiple target portions, and, more specifically, toward a multi-sport, game apparatus including a frame that is convertible from a storage configuration to one or more game configurations, and vice versa. The present invention is further directed to a multi-sport, game apparatus including a basket configured to receive a basketball, a first target portion configured to receive a first sports implement thrown by a user of the apparatus, and a second target portion configured to receive a second sports implement propelled along a support surface by a user of the apparatus. The game apparatus may further include a return portion configured to return the basketball after it is shot by a user toward the basketball basket and to return the first sports implement thrown by a user toward the first target portion.

BRIEF DESCRIPTION OF THE DRAWINGS

Like reference numerals have been used to identify like elements throughout this disclosure.

DETAILED DESCRIPTION

Figure 1:
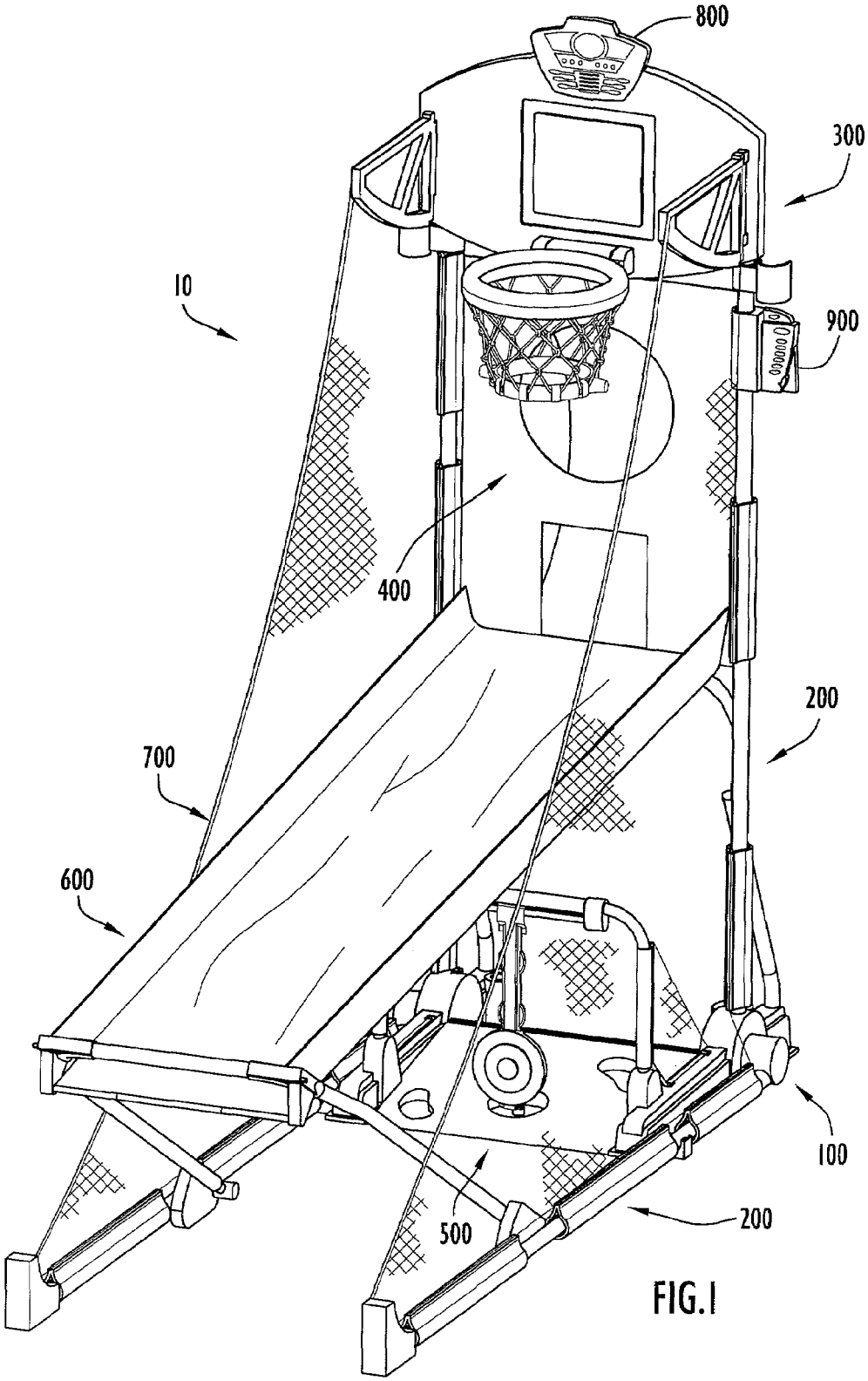
FIG. 1 illustrates a perspective view of a multi-sport, game apparatus according to an embodiment of the present invention.

In accordance with the present invention, a reconfigurable apparatus for use with various sports implements and including separate target areas is disclosed. FIG. 1 illustrates a perspective view of a multi-sport, game apparatus according to an embodiment of the present invention. As shown, the sports apparatus 10 includes a base 100, a frame 200, a basketball area 300, a first target portion or area 400, a second target portion or area 500, a ball/implement return portion or mechanism 600, and one or more sidewalls or containment members 700. In addition, the apparatus 10 may include a display device or unit 800 and a switch box or housing 900.

Figure 2:
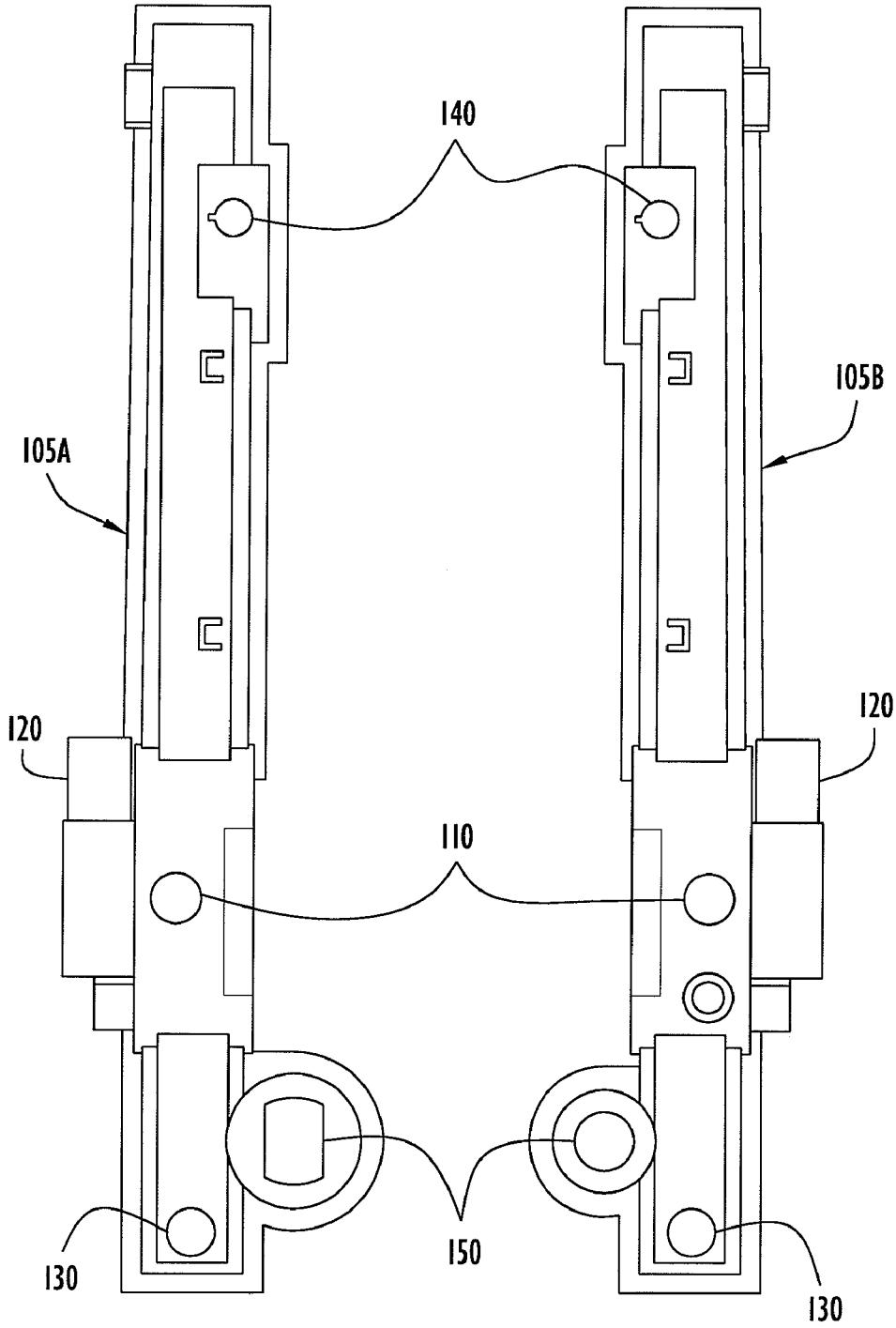
FIG. 2 illustrates an isolated, top perspective view of the base members of the apparatus of FIG. 1.

The base 100 includes a structure configured to support the frame 200 on a supporting surface. FIG. 2 illustrates an isolated, top perspective view of the base 100 of the apparatus of FIG. 1. In the embodiment shown, the base 100 includes a left base member 105A and right a base member 105B. Each base member 105A, 105B includes a stationary frame receptacle 110 and a pivoting frame receptacle 120. The receptacles 110, 120 may be configured to receive and secure portions of the frame 200. Each pivoting frame receptacle 120 is configured to rotate a predetermined amount. For example, it may be configured to rotate approximately 90°. The base members 105A, 105B may further include a clamp (not illustrated in this Figure, but shown and referenced as 160 in FIGS. 4A and 4B) configured to secure a portion of the frame in a deployed configuration (discussed in greater detail below). In addition, each base member 105A, 105B may include an auxiliary support receptacle 130, a goal support receptacle 140, and storage receptacles 150 (also discussed in greater detail below). The base 100 may assume any appropriate configuration and, as such, is not limited to the embodiment illustrated in the Figures.

Figure 3:
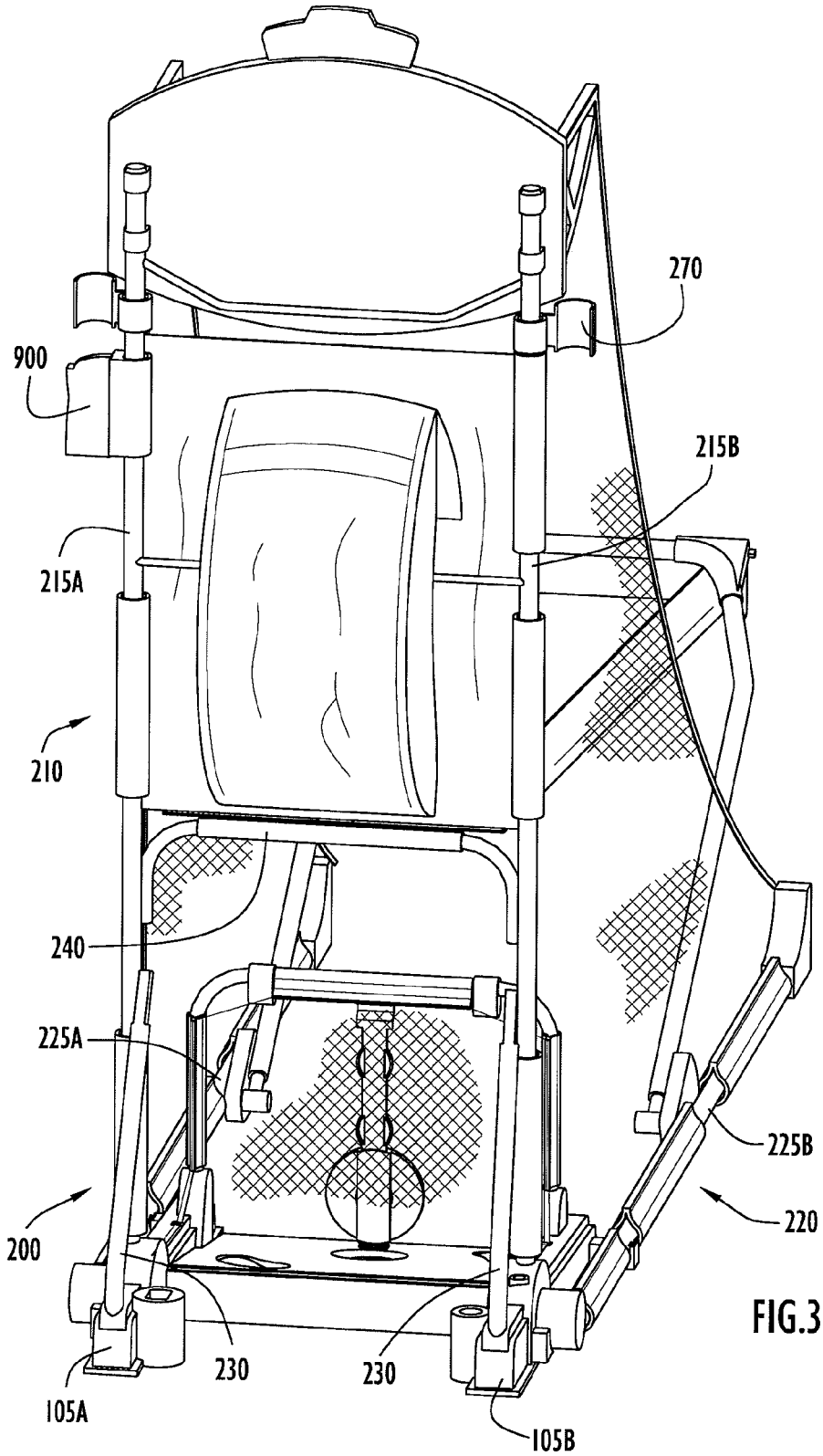
FIG. 3 illustrates a rear perspective view of the apparatus of FIG. 1.

The frame 200 includes a structure configured to support multiple, separated target portions. FIG. 3 illustrates a rear perspective view of the multi-sport, game apparatus 10 of FIG. 1. As shown, the frame 200 includes vertical supports 210 (also called upright sections) and repositionable supports 220. The vertical supports 210 may include a left post 215A and a right post 215B extending upward from the base members 105A, 105B and the supporting surface. The posts 215A, 215B may be configured to slide into and be secured by the stationary frame receptacles 110 of the corresponding base member 105A, 105B. The frame 200 may further include auxiliary support posts 230 configured to extend from the posts 215A, 215B to the auxiliary support receptacles 130 of the base members 105A, 105B, as well as a crossbar 240 extending from the left vertical post 215A to the right vertical post 215B. The auxiliary support posts 230 and the crossbar 240 may provide additional stability and strength to the frame 200.

Figure 4A:
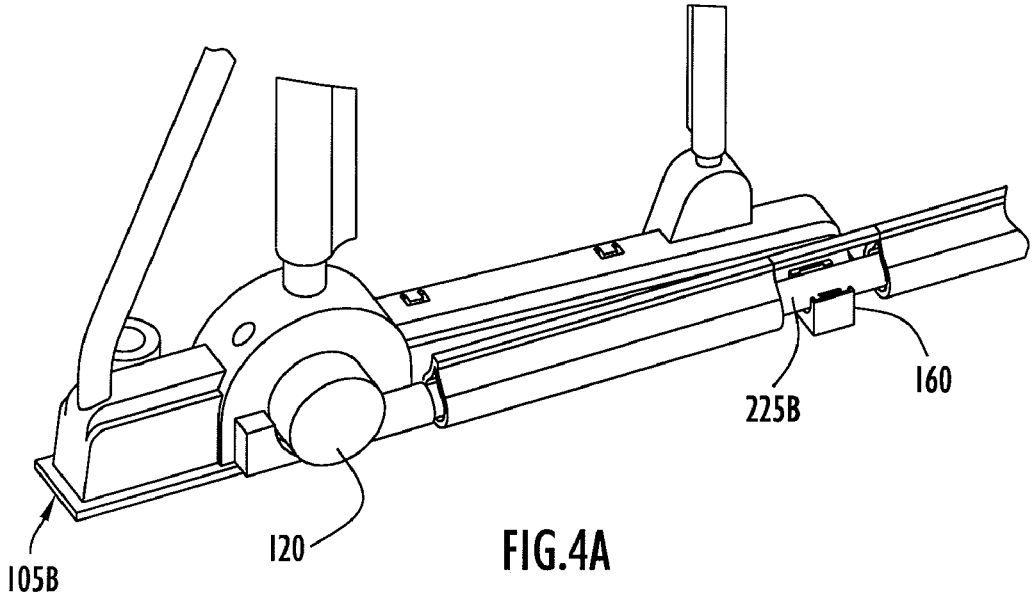
FIGS. 4A and 4B illustrate a close-up view of the right base member of the apparatus of FIG. 1, showing the pivot mechanism of the base members.
Figure 4B:
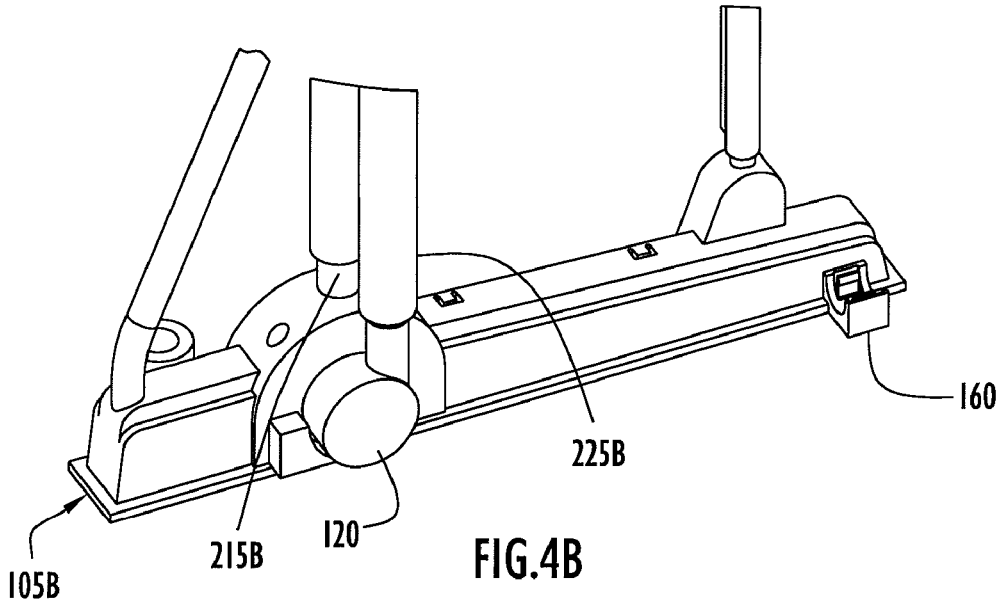

The repositionable supports 220 may similarly include a left post 225A and a right post 225B (called retention members) configured to engage and be secured by the pivoting frame receptacles 120 of the corresponding base member 105A, 105B. Securing the retention members 225A, 225B to the pivoting frame receptacles 120 enables the retention members 225A, 225B to be rotated in predetermined amounts and directions. FIGS. 4A and 4B illustrate a close-up view of the right base member 105B of the apparatus 10 of FIG. 1, showing the pivot mechanism of the right retention member 225B. Specifically, the pivoting receptacle 120 may rotate approximately 90° from a position in which the right retention member 225B is substantially horizontal with respect to the supporting surface (as shown in FIG. 4A), to a position in which the right retention member 225B is substantially vertical with respect to the supporting surface (and substantially parallel with respect to the right vertical support post 215B) (as shown in FIG. 4B). The left retention member 225A may function in a similar manner. The pivoting receptacles 120 of the base members 105A, 105B may be linked such that rotating one of the retention members 225A, 225B causes the other retention member to also rotate.

Each base member 105A, 105B may further include post clamps 160 operable to secure the retention members 225A, 225B in the substantially horizontal orientation. Similarly, the vertical supports 210 may include C-shaped clamps 270 (not shown in FIGS. 4A and 4B, seen best in FIG. 3) to secure the retention members 225A, 225B in the substantially vertical orientation. In addition, the terminal end of each retention member 225A, 225B (i.e., the end furthest from its base member 105A, 105B) may include a foot (shown in FIG. 1) operable to provide additional stability to the apparatus 10.

In operation, a user or player may selectively arrange and secure the retention members 225A, 225B in either a substantially vertical or substantially horizontal orientation. As such, the repositionable supports 220 may be set in an upright, storage configuration, where the repositionable supports 220 are substantially vertical with respect to the supporting surface (as shown in FIG. 4B), or in a downward, ball containment or deployed configuration, where the repositionable supports 220 are substantially horizontal with respect to the supporting surface (as shown in FIG. 4A). In either configuration, the multi-sport, game apparatus 10 is freestanding.

Figure 5A:
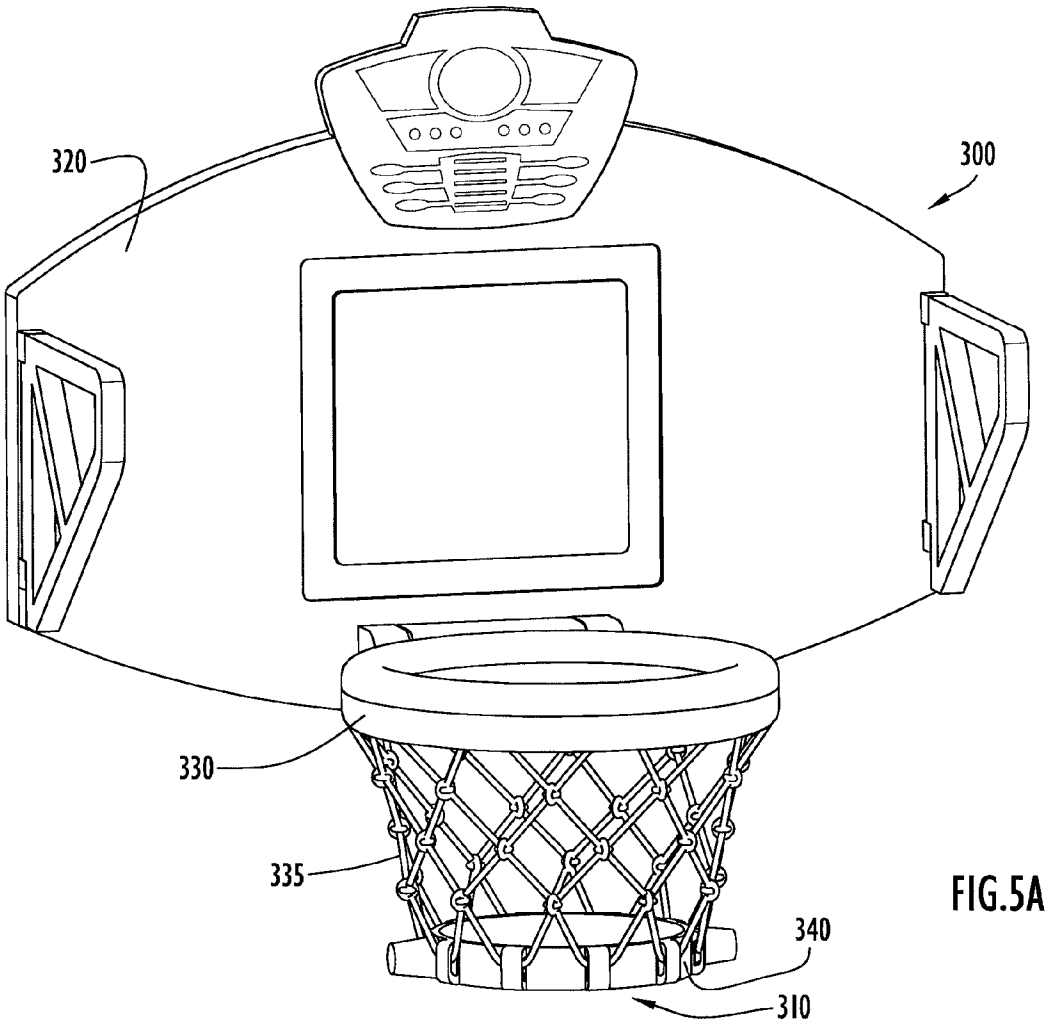
FIGS. 5A–C illustrate perspective, close-up views of the basketball portion of the apparatus of FIG. 1.
Figure 5B:
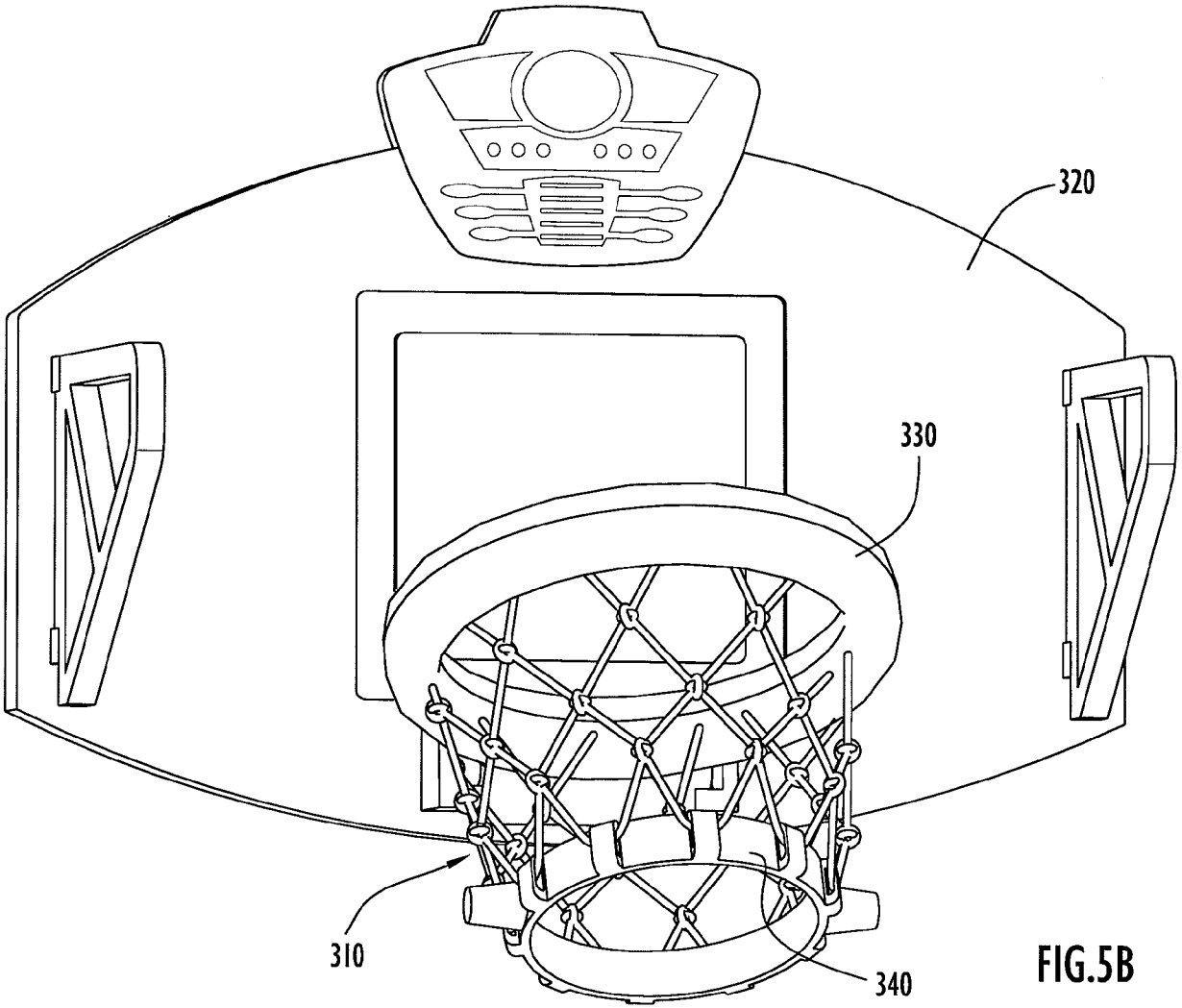
Figure 5C:
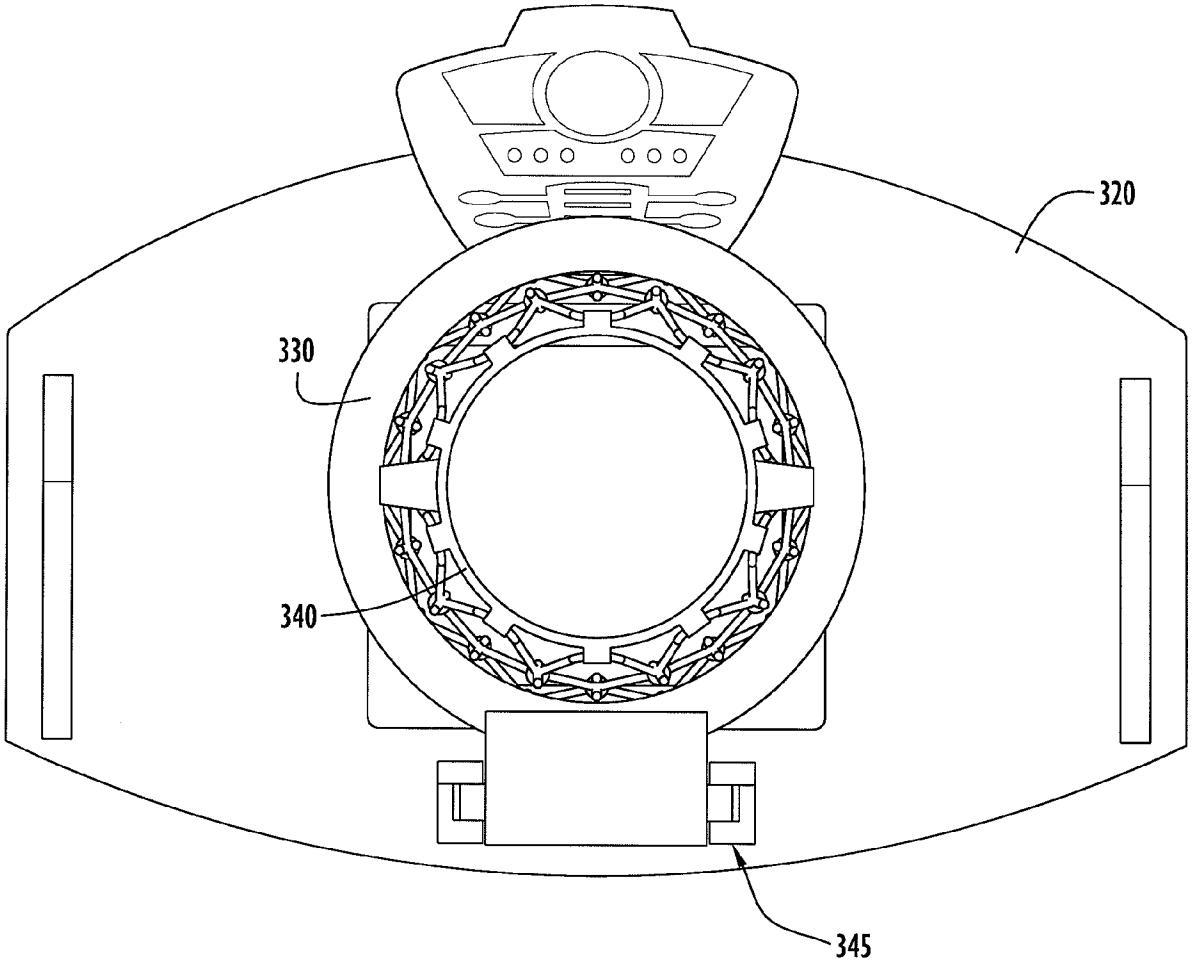

FIGS. 5A–C illustrate perspective, close-up views of the basketball portion 300 of the multi-sport, game apparatus 10 of FIG. 1. In the embodiment shown in FIG. 5A, the basketball portion 300 may include a basket 310 and a backboard 320. The basket 310 may include a structure configured to receive a sports implement that is shot by a user of the apparatus 10 (e.g., a basketball). By way of specific example, the basket 310 may include a rim (upper ring) 330 and a lower ring 340. The rings 330, 340 may be sized to permit a basketball to pass therethrough. The upper and lower rings 330, 340 may be connected by a net 335. The net 335 may be made of any suitable material (e.g., fabric mesh). The upper ring 330 and the lower ring 340 may have the same or different diameters. Preferably, the lower ring 340 comprises a smaller diameter than that of the upper ring 330. With this configuration, the lower ring 340 may be positioned and contained within the upper ring 330. For example, the lower ring 340 may be inserted into the upper ring 330 for storage (as explained in further detail below).

The backboard 320 includes a structure configured to attach to the frame 200, as well as to support the basket 310 over the supporting surface. The backboard 320 is not limited to any specific construction and may be formed from any suitable material (e.g., rigid plastic). The backboard 320 may be connected to the vertical supports 210 proximate their edges. The manner in which in which the backboard 320 is attached to the vertical supports 210 is not limited. By way of example, the backboard 320 may include a pair of vertical channels positioned and sized to receive the vertical supports 210 of the frame 200 (best seen in FIG. 3). Alternatively, fastening devices such as clamps or screws may be used to secure the basketball portion 300 onto the vertical supports 210.

The basket 310 may be rigidly connected to the backboard 320, or may be hingedly connected to the backboard 320 to allow its rotation from a substantially vertical orientation to a substantially horizontal orientation (with respect to the supporting surface), and vice versa. FIGS. 5A–C illustrate the method by which the basket 310 may be rotated (folded). Specifically, the basket 310 may be connected to the backboard 320 via a hinge 345 (best seen in FIG. 5C) that permits rotation of the basket 310. As a result, the basket 310, beginning its horizontal, deployed position (see FIG. 5A), may be rotated upward (see FIG. 5B) until it contacts the backboard 320 and comes to rest in its vertical, storage, or non-use position (see FIG. 5C). As shown in FIG. 5C, when the basket 310 is oriented vertically, the lower ring 340 may be nested inside the upper ring 340, providing for more compact storage of the basket 310.

The basket 310 may further include one or more sensor elements operable to detect the presence of a basketball in proximity to the basket 310. By way of example, a sensor may be positioned within the basket 310 to detect the presence of a sports implement within the upper ring 330, the lower ring 340, or both. The type of sensor is not limited, and includes optical, magnetic, electric, and mechanical sensors. By way of specific example, one or more optical sensors may be positioned in both the upper ring 330 and the lower ring 340. The optical sensors may include an emitter spaced in a diametrically opposed relationship to a receiver along a ring 330, 340. The emitter is adapted to direct a beam of light across the passageway (the diameter) of the rings 330, 340 to its associated receiver. Consequently, when an object (a sports implement) passes through the rings 330, 340, the light beams are interrupted, closing the switches and generating a signal. The type of emitter and receiver is not limited. By way of specific example, the emitters may comprise a red ultrabright light emitting diodes (LEDs) (sold under the trade name W05310RUC-DI) and the receivers may comprise CdS photoconductive cells (sold under the trade name KE-15930), both available from Waitrony Co., Ltd., China (www.waitrony.com).

Figure 6:
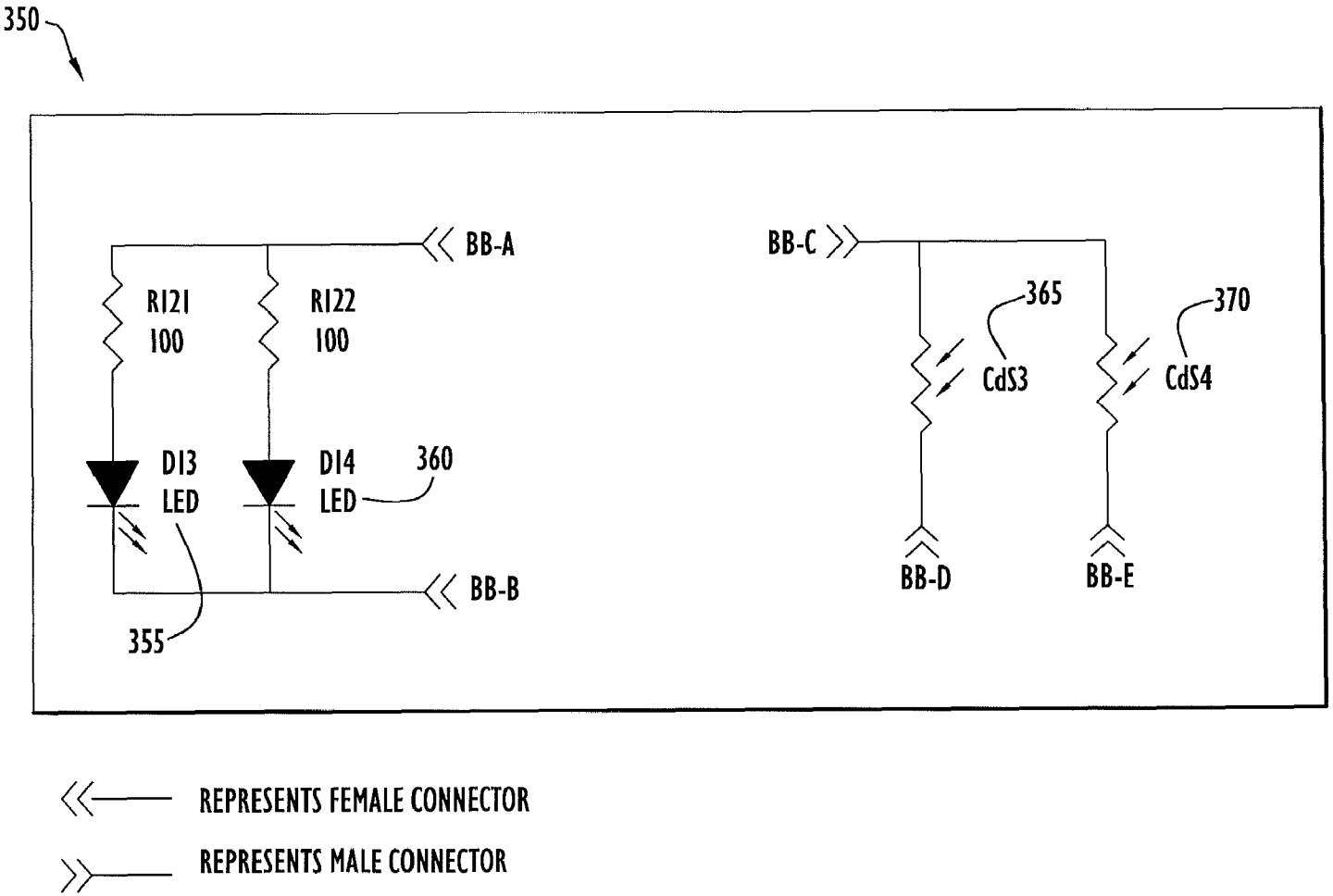
FIG. 6 illustrates a schematic diagram of an example of an electronic sensor configuration for use in the basketball portion of the apparatus of FIG. 1.

FIG. 6 illustrates a schematic diagram of an electronic sensor configuration appropriate for use with the basketball portion 300. As shown in the embodiment of FIG. 6, the electronics configuration 350 includes a first LED emitter 355 paired with a corresponding receiver 365 and a second LED emitter 360 paired with a corresponding receiver 370. Both emitter/receiver pairs 355/365, 360/370 may be operably connected to a control unit (not shown, discussed in greater detail below) and configured to send a signal to the control unit when either one or both of the light beams produced by the emitter 355, 360 is interrupted. Specifically, the first emitter/receiver pair 355/365 may be positioned in diametrically opposed relations within the upper ring 330 and the second emitter/receiver pair 360/370 may be positioned in diametrically opposed relation within the lower ring 340. In operation, a basketball passing through the basket 310 may interrupt the light from both emitters 355, 360 to both receivers 365, 370 (preventing the beam from being received by both receivers 365, 370). This interruption may generate a signal that is sent to the control unit. The control unit, in turn, may generate appropriate output (e.g., a sound effect, music, increase of displayed score, etc.)

Figure 7A:
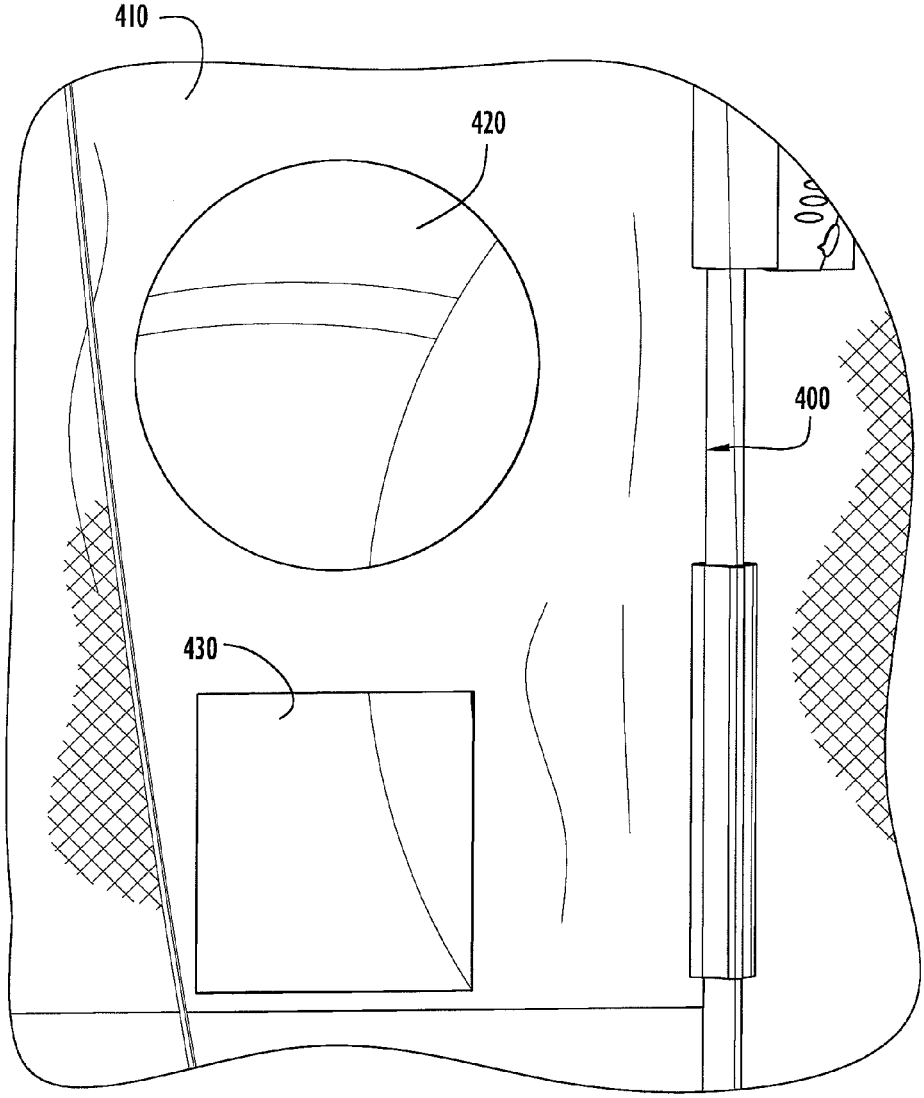
FIGS. 7A and 7B illustrate front and rear perspective views of the first target portion of the apparatus of FIG. 1.
Figure 7B:
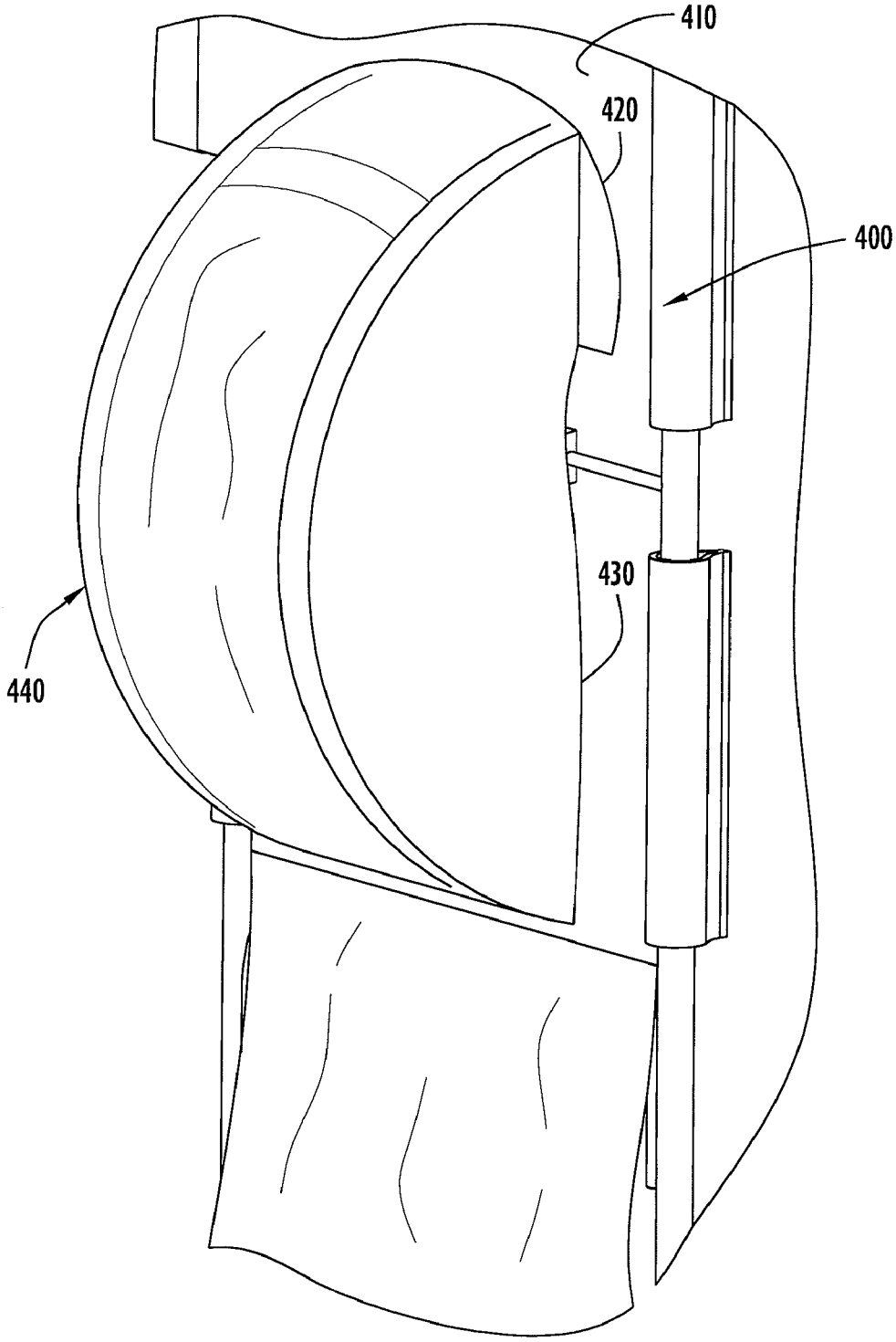

The first target portion 400 includes a structure configured to receive and/or release a sports implement. FIG. 7A illustrates a front perspective view of the first target portion 400 of the multi-sport, game apparatus of FIG. 1. FIG. 7B illustrates a corresponding rear view of the first target portion 400. As shown in the embodiment of FIGS. 7A–B, the first target portion 400 may comprise a panel or backing 410 extending from the lower edge of the backboard 320 to the upper edge of the second target portion 500. The material comprising the panel 410 is not limited. For example, the panel 410 may comprise a durable woven or non-woven fabric (e.g., canvas or polyester). The panel 410 may further include indicia printed thereon. In another embodiment, the panel 410 may be configured for interchangeability. For example, the panel 410 may comprise multiple panels (one on top another), wherein the top panel can be removed or repositioned to permit the underlying panel be displayed.

Referring to FIG. 7A, the panel 410 may include a sports implement entrance or orifice 420 and a sports implement exit 430 positioned below the entrance 420. The sports implement used with the first target portion 400 is not particularly limited, and includes those thrown by a user or player of the multi-sport, game apparatus 10. By way of example, a thrown sports implement may include a baseball, a softball, or a football. The entrance 420 includes a structure operable to permit one or more sports implements to pass therethrough. As shown in the embodiment of FIGS. 7A and 7B, the entrance 420 may comprise a generally annular ring oriented vertically with respect to the supporting surface. Similarly, the exit 430 includes a structure configured to permit the passage of a sports implement therethrough.

Referring specifically to FIG. 7B, the entrance 420 and exit 430 may be connected by a sleeve or channel 440. The sleeve 440 includes a structure operable to direct a sports implement from the entrance 420 to the exit 430. The sleeve 440 may include durable fabric similar to that comprising the panel 410. The sleeve 440 may substantially encase the entrance 420 and the exit 430 to define a confined passageway from the entrance 420 to the exit 430. Specifically, the sleeve 440 may include fabric that extends from the back of the entrance 420, curves downward, and returns to the back of the exit 430. A brace (e.g., an annular ring oriented horizontally with respect to the supporting surface (not shown)) may be positioned within the sleeve 440 (e.g., between the entrance 420 and the exit 430) to provide additional support and to further maintain the shape and form of the passageway within the sleeve 440.

With this configuration, when a sports implement such as a football or baseball is thrown by a user of the multi-sport, game apparatus 10 toward the first target portion 400, the sports implement may pass through the entrance 420 and contact the curved wall of the sleeve 440. The curve of the sleeve (as well as gravity) directs the sports implement downward, toward the exit 430. The sports implement then passes through the exit 430, and out toward the front surface of the first target portion 400.

The first target portion 400 may further include one or more sensor elements operable to detect the passage of a sports implement through the entrance 420, the sleeve 440, and/or the exit 430. The type of sensor is not limited, and includes mechanical, optical, electric, and magnetic sensors. By way of example, the sensor may comprise an optical sensor including an opposed emitter/receiver pair. The pair may be adapted to generate a signal when the light beam traveling from the emitter to the receiver is interrupted. By way of specific example, the emitter may comprise a red ultrabright light emitting diode (LED) (sold under the trade name WO5310RUC-DI) and the receiver may comprise a CdS photoconductive cell (sold under the trade name KE-15930), both available from Waitrony Co., Ltd., China (www.waitrony.com).

Figure 8:
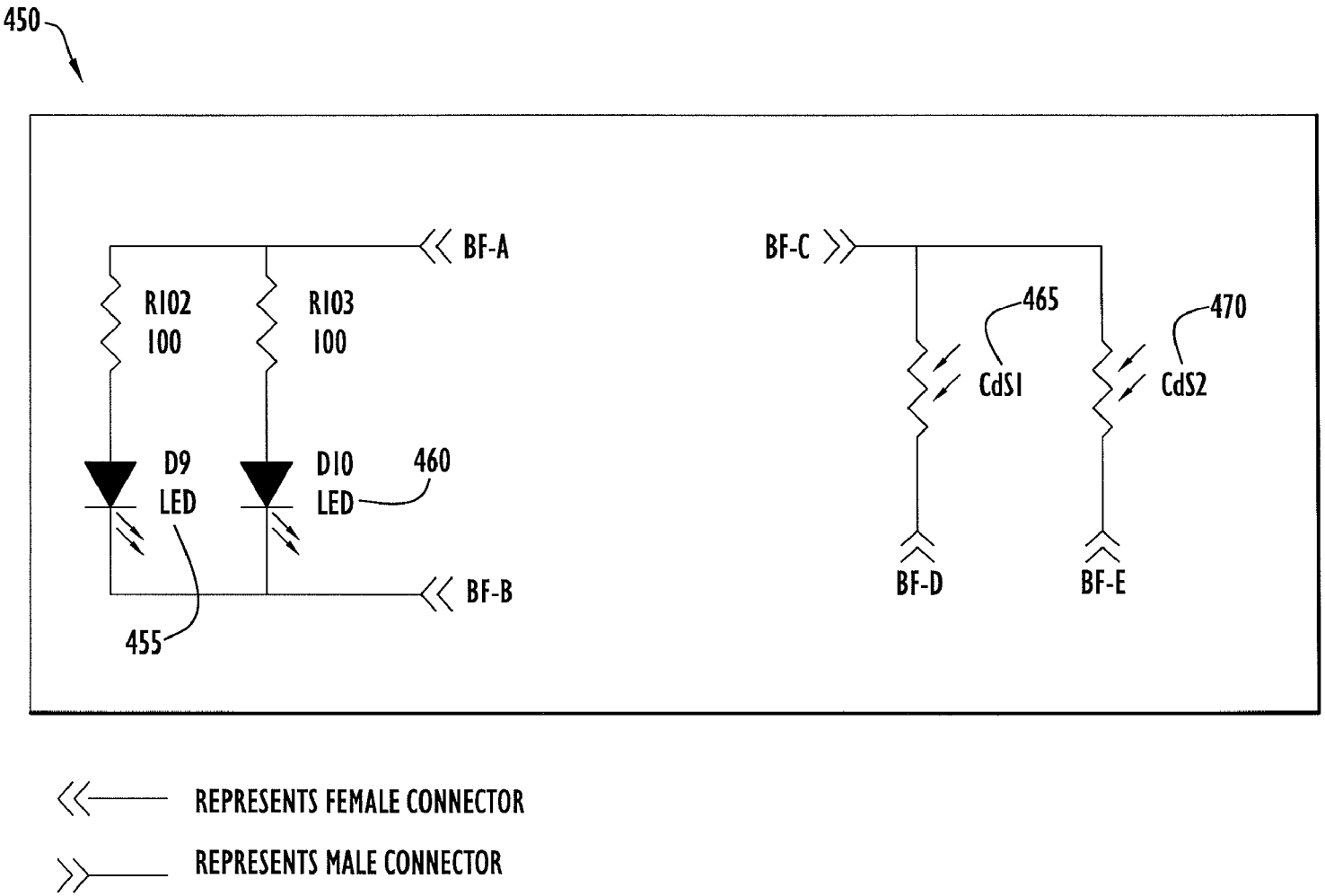
FIG. 8 illustrates a schematic diagram of an example of an electronic sensor configuration for use in the first target portion of FIG. 7A.

FIG. 8 illustrates a schematic diagram of an example of an electronic sensor configuration for use in the first target portion 400 of FIG. 7A. As shown in the embodiment of FIG. 8, the electronic configuration 450 includes a first LED emitter 455 paired with a corresponding first receiver 465 and a second LED emitter 460 paired with a corresponding second receiver 470. The emitters 455, 460 are positioned to direct a beam of light across the travel path of a sports implement through the sleeve 440. As a result, when a user throws a sports implement through the entrance 420 and the sports implement passes through the sleeve 440, the beam of light traveling from the emitters 455, 460 to the receivers 465, 470 will be interrupted, closing the switch and generating a signal. Both emitter/receiver pairs 455/465, 460/470 may be operably connected to a control unit (not shown, discussed in greater detail below) and configured to send a signal to the control unit when either one or both of the beams are interrupted. The emitter/receiver pairs 455/465, 460/470 may be located on the entrance 420 or within the sleeve 440. In the embodiment of the multi-sport, game apparatus 10 shown in FIG. 1, the emitter/receiver pairs 455/465, 460/470 are housed in the brace within the sleeve 440.

Figure 9:
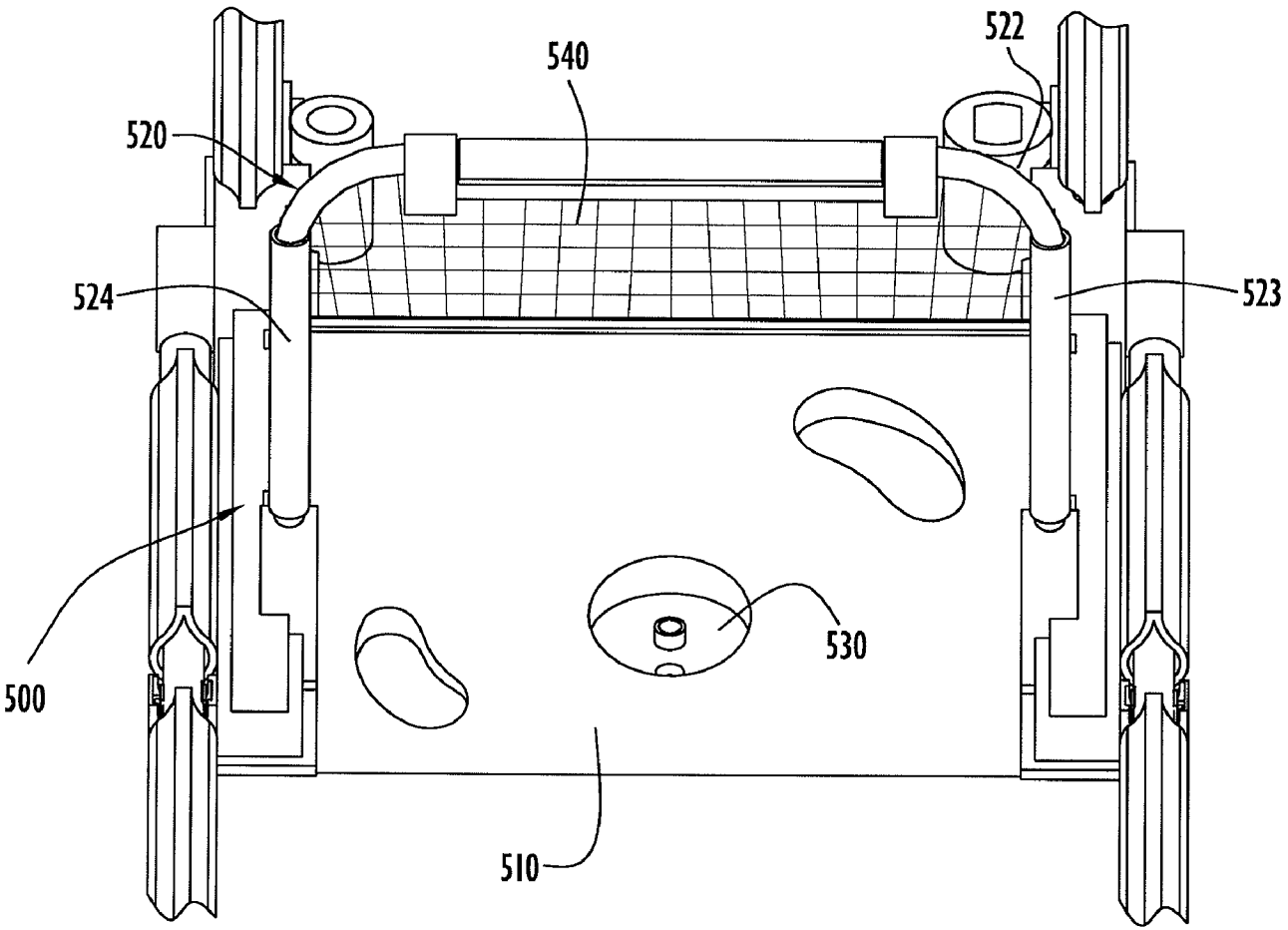
FIG. 9 illustrates a front perspective view of the second target portion of the apparatus of FIG. 1.

The second target portion 500 is configured to receive a sports implement propelled along the supporting surface by a user of the multi-sport, game apparatus 10. The phrase "along the supporting surface" includes rolling, bouncing and/or sliding contact with the supporting surface, as well as travel slightly above (proximate) the supporting surface. By way of example, a propelled sports implement may include a soccer ball, a hockey puck, a hockey ball, and/or a golf ball. FIG. 9 illustrates a perspective view of the second target portion 500 of the multi-sports apparatus of FIG. 1. In the embodiment shown, the second target portion 500 may include a floor plate 510 and a goal 520. The floor plate 510 may connect to the base 100 and be positioned between the left and right base members 105A, 105B. The floor plate 510 may include a structure adapted to permit a sports implement rolling along the supporting surface (such as a golf ball) to continue its path of travel and roll onto the plate 510. By way of example, the plate 510 may include a generally planar surface positioned proximate the supporting surface.

The floor plate 510 may further include a cup or receptacle 530 positioned along its upper surface. The cup 530 may include an orifice configured to receive a propelled sports implement (e.g., a golf ball). As shown in FIG. 9, the floor plate 510 may be stylized as a putting green with a golf cup 530 positioned proximate the center of the green. As illustrated, the floor plate 510 may include surface with a downward incline extending from the rear of the multi-sport, game apparatus 10 to its front. With this structure, when a ball propelled by a user does not drop into the cup 530, the inclined floor plate 510 causes the ball to rollback toward the user.

The goal 520 includes a structure configured to receive a sports implement propelled along the supporting surface by a user. Referring to FIG. 9, the goal 520 may be stylized as a soccer or hockey goal. Specifically, the goal 520 includes a frame having an inverted U-shape, with a crossbar 522 separating two vertical uprights 523, 524. The goal 520 may be positioned proximate the front of the floor plate 510, with the vertical uprights 523, 524 of the goal 520 connecting to the goal receptacles 140 of the base members 105A, 105B (see FIG. 2). Thus, the goal 520 may be removable to accommodate golf play. A net 540 may extend from the crossbar 522 to the rear of the floor plate 510. As with the golf configuration, the inclined structure of the floor plate 510 may direct a sports implement such as a soccer ball back toward the user.

Figure 10:
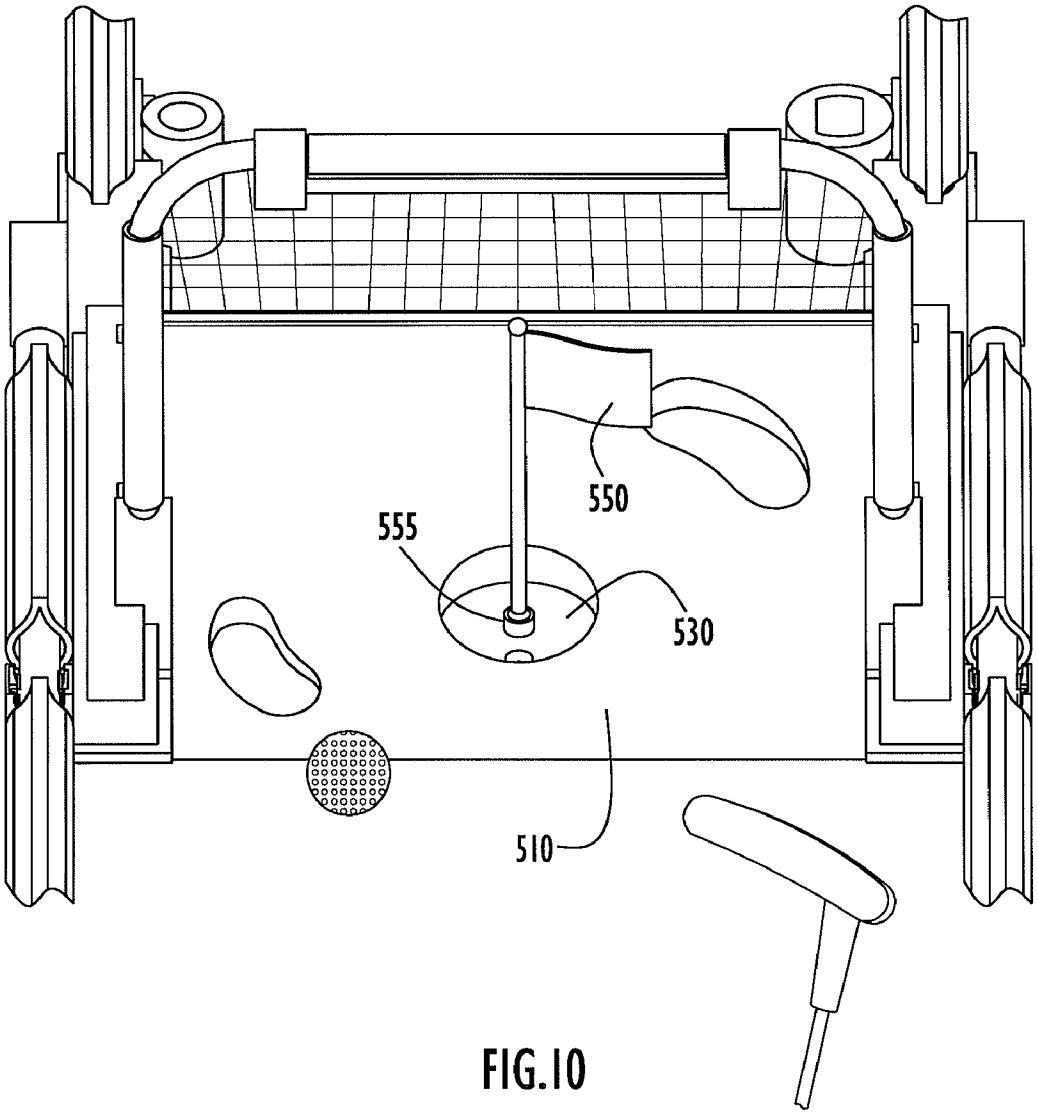
FIGS. 10 and 11 illustrate front perspective views of the second target portion of FIG. 9, showing interchangeable game markers according to embodiments of the present invention.
Figure 11:
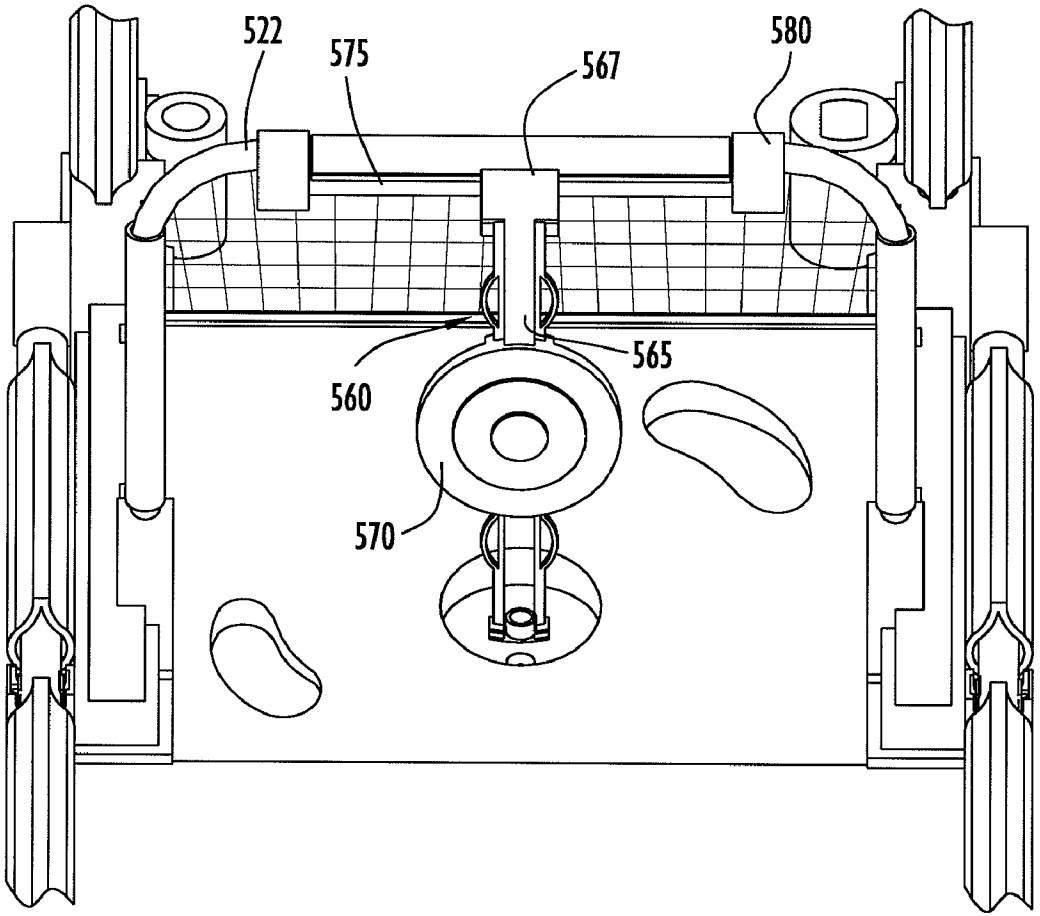

The second target portion 500 may further include a removable marker/target. FIGS. 10 and 11 illustrate perspective views of the second target portion 500 of FIG. 9, further illustrating interchangeable game markers/targets according to embodiments of the present invention. Referring first to FIG. 10, the floor plate 510 may be adapted to receive a removable, stationary marker 550. In the embodiment of FIG. 10, the stationary marker 550 may be stylized as a golf flag (i.e., a golf green marker) adapted to frictionally engage a marker channel 555 positioned proximate the center of the cup 530 and extending upward from the cup's bottom surface.

Referring to FIG. 11, the goal 520 may be adapted to support a moveable target 560. In the embodiment of FIG. 11, the moveable target 560 may include a support post 565 and target with a bull's-eye 570. The support post 565 may connect to the goal 520, suspending the bull's eye 570 over the floor plate 510 in the mouth of the goal 520 such that the target 560 is capable of swinging. Specifically, a target rod 575 may extend along a portion of the crossbar 522 of the goal 520. The target rod 575 may be suspended from the crossbar via a pair of brackets 580 positioned on either side of the target rod 575. The target rod 575 may be pivotally connected to the brackets 580 such that when a force is applied to the target 560, the target 560 will rotate forward and backward. The support post 565 may include a hooked end 567 configured to frictionally (but removably) engage the target rod 575. The target 560, moreover, may be adjustable in height. The bull's eye 570 may slide vertically along the support post 565 such that the height of the bull's eye 570 is variable. The support post 565 may also slide horizontally along the target rod 575 such that the horizontal position of the bull's eye 570 along the target rod 575 (and along the mouth of the goal 520) is variable.

Figure 12:
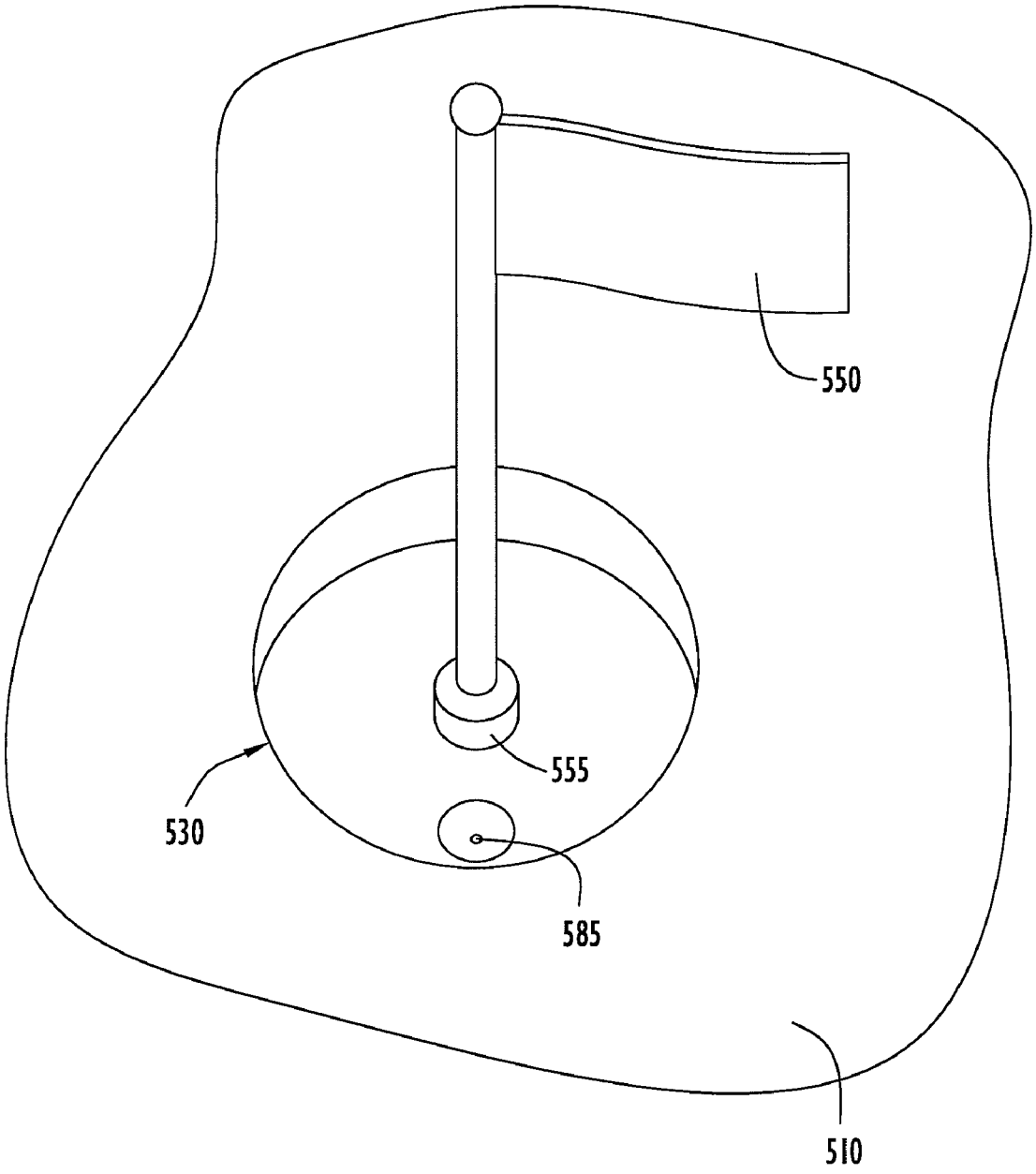
FIG. 12 illustrates a close-up perspective view of the golf cup of the second target portion of FIG. 9.
Figure 13:
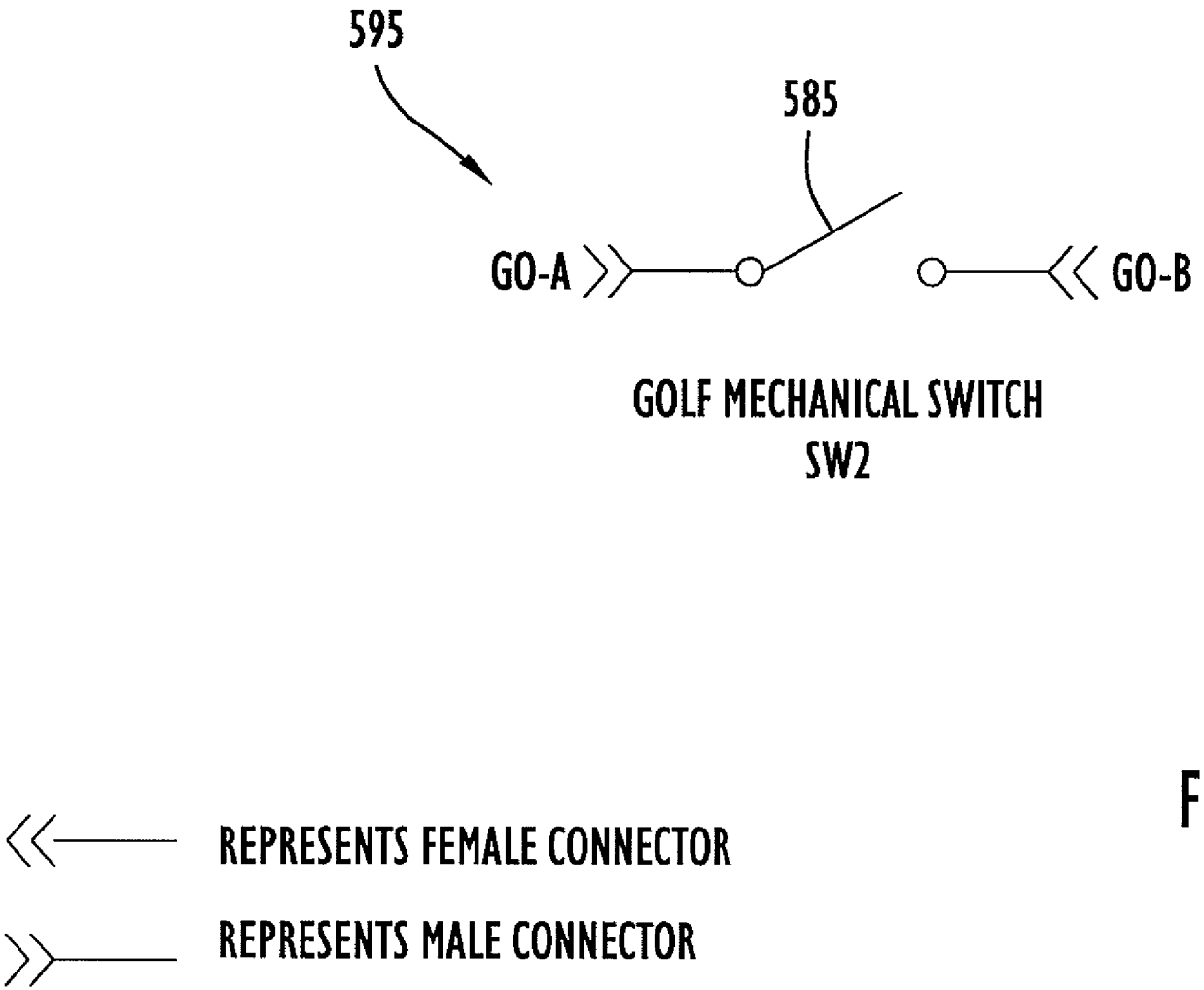
FIG. 13 illustrates a schematic diagram of an example of an electronic sensor configuration for use in the cup of the second target portion of FIG. 12.

The second target portion 500 may further include one or more sensor elements adapted to detect the presence of a propelled sports implement. The type of sensor is not limited, and includes optical, mechanical, magnetic, and electrical sensors. By way of example, the cup 530 of the floor plate 510 may include a sensor operable to detect the presence of a sports implement within the cup 530. FIGS. 12 and 13 illustrate examples of sensor configurations for use with the second target portion 500. In the embodiment of FIG. 12, the cup 530 may include a mechanical switch 585 positioned along the bottom surface of the cup 530. The switch 585 may be adapted to generate a signal whenever a sports implement such as a golf ball falls into the cup 530. Specifically, the switch may comprise a pressure sensitive switch capable of being engaged by golf ball contact (i.e., when the golf ball falls in the cup 530, it closes the switch 585). The bottom surface of the cup 530 may include a slanted inner surface to direct the golf ball to a desired portion of the cup 530 where the switch 585 is located. For example, in the embodiment of FIG. 12, the switch 585 is positioned proximate the front of the cup 530; consequently, the bottom surface of the cup 530 may decline from back to front within the cup 530 to direct the golf ball toward the switch 585. The area surrounding the switch 585 may further include an indented surface to further direct the ball toward the switch 585.

FIG. 13 illustrates a schematic diagram of an example of an electronic sensor configuration 595 for the cup 530 of the second target portion 500. In the embodiment of FIG. 13, the sensor configuration 595 may include a mechanical leaf-type switch 585 operatively connected to a control unit (not shown). When a ball enters the cup, it engages the switch 585, generating a signal that is sent to the control unit. The control unit, in response to the signal, may generate sensory output (e.g., music, lights, sound effects, score tracking, etc.).

Figure 14A:
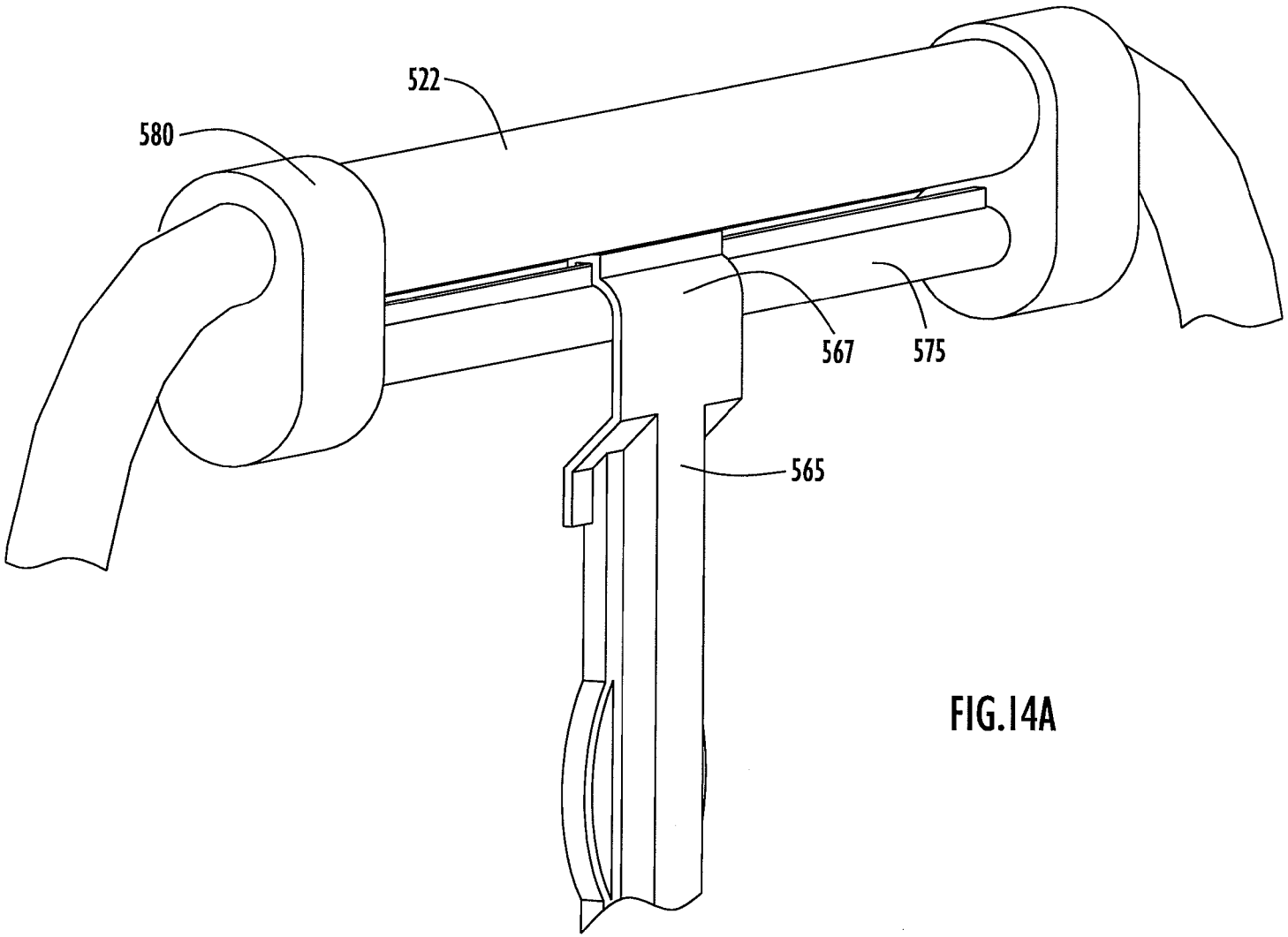
FIGS. 14A–C illustrate a swinging target mechanism suitable for use with the second target portion of FIG. 9 according to embodiment of the present invention.
Figure 14B:
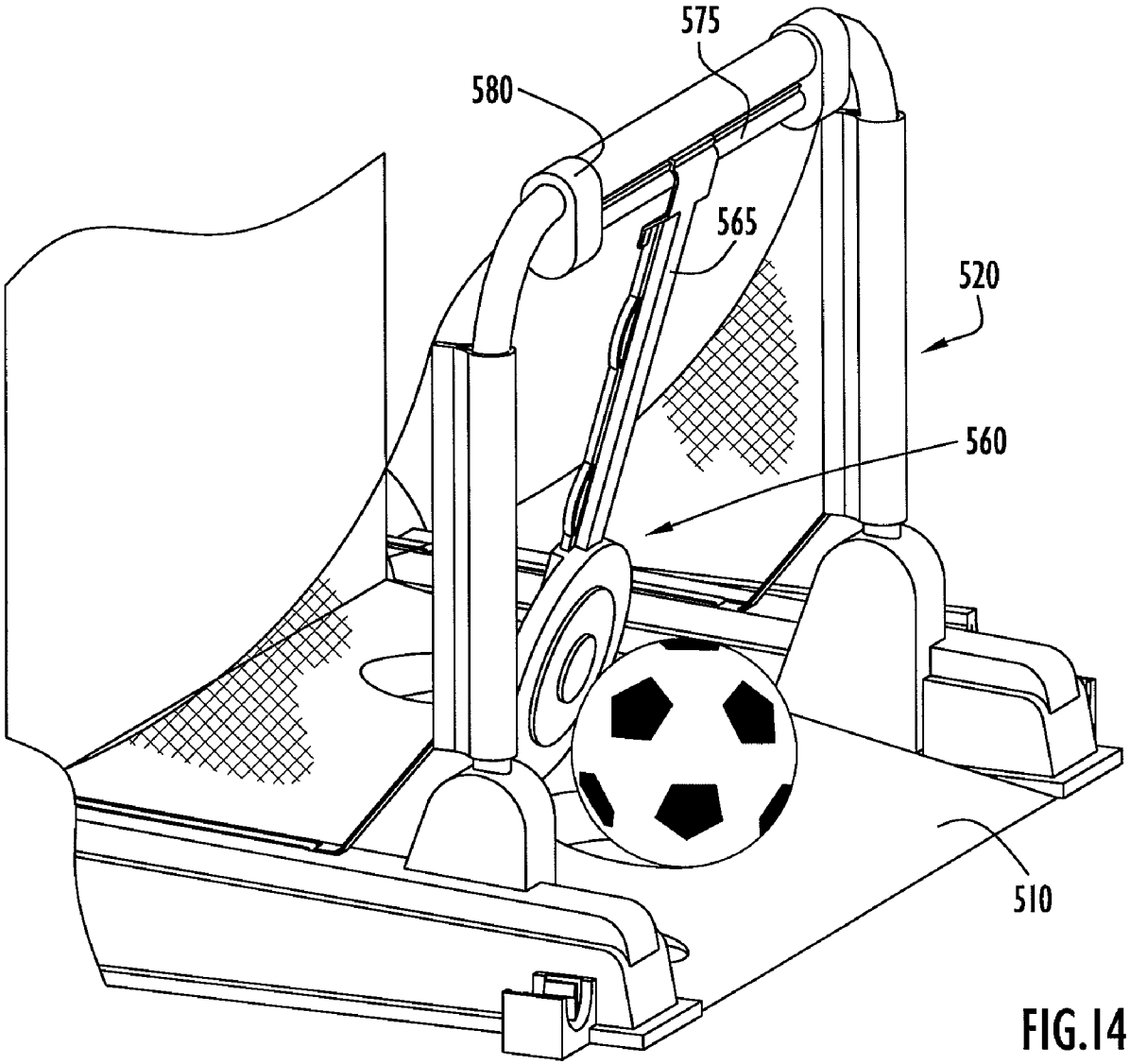
Figure 14C:
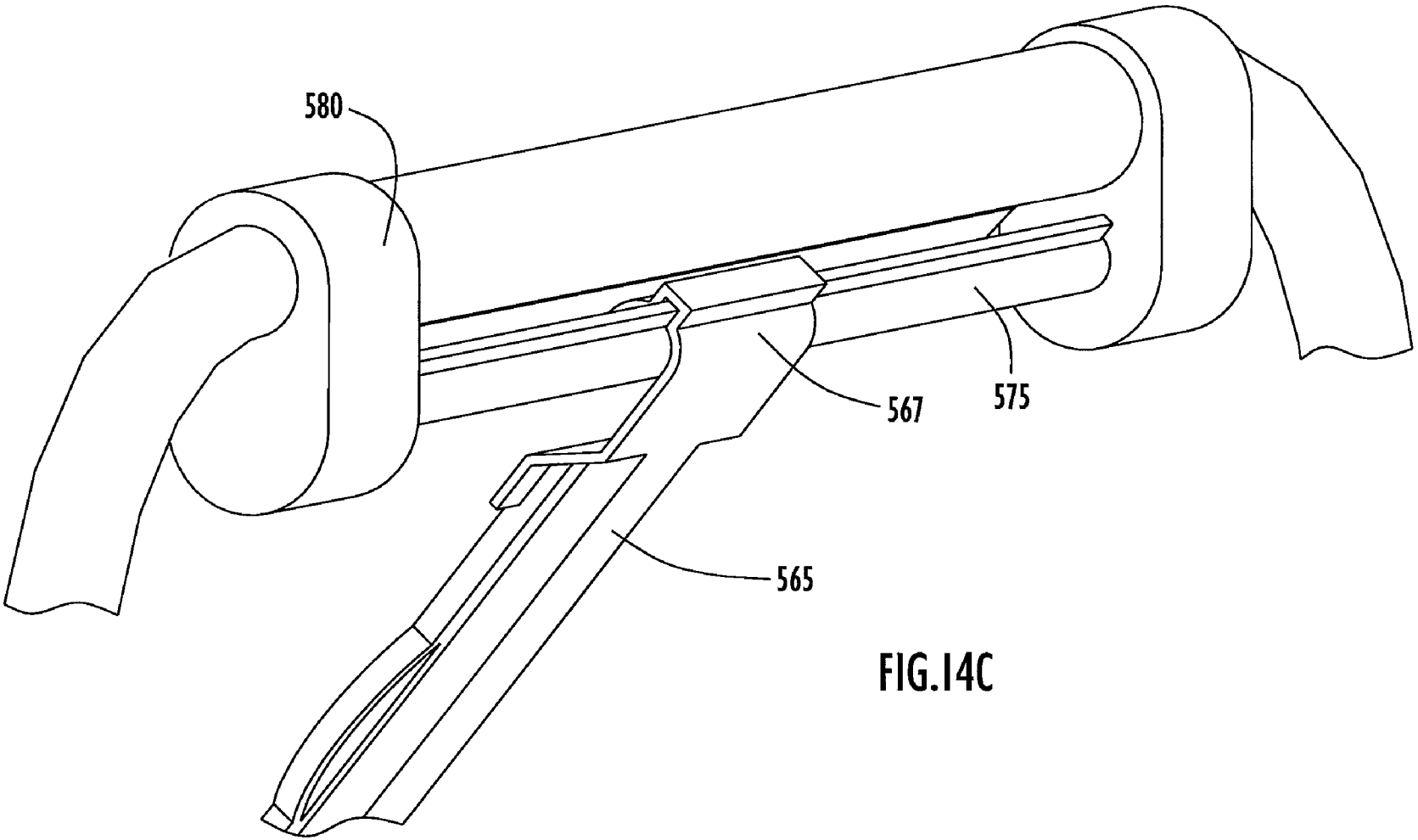

As referenced above, the goal 520 may also include a sensor operable to detect the presence of a propelled sports implement (e.g., a hockey puck or a soccer ball). FIGS. 14A–C illustrate another embodiment of a sensor configuration for the second target portion. More specifically, FIGS. 14A–C illustrate a swinging target/sensor mechanism suitable for use with the second target portion 500 according to an embodiment of the present invention. FIGS. 14A and 14C are isolated perspective views of the crossbar 522 of the goal 520, showing the hooked end 567 of the support post 565 connected to the target rod 575. The brackets 580 supporting the target rod 575 may include a sensor that is engaged when the target rod 575 is pivoted. The sensor, in turn, may be operably coupled to a control unit (not shown) such that the sensor generates and sends a signal to the control unit. In operation, the target rod 575 may begin in its normal (resting) position as illustrated in FIG. 14A. A user may propel a sports implement (e.g., a soccer ball or hockey puck) toward the bull's eye 570 of the target 560. When the ball or puck contacts the bull's eye 570 of the target 560, the force created pushes the entire target 560, including the support post 565, backward, toward the rear of the goal 520 (illustrated in FIG. 14B). As the support post 565 of the target 560 pivots, the interaction of the hooked end 567 of the support post 565 with the target rod 575 causes the target rod 575 to also pivot (illustrated in FIGS. 14B and 14C). A sensor such as a mechanical switch positioned within one or both of the brackets 580 may be engaged by target rod 575 as it rotates (e.g., via a cam associated with the target rod 575 and positioned to contact the switch). When the switch is engaged, a signal is sent to the control unit, which, in turn generates appropriate sensory output (music, sound effects, score tracking, etc.).

Figure 15:
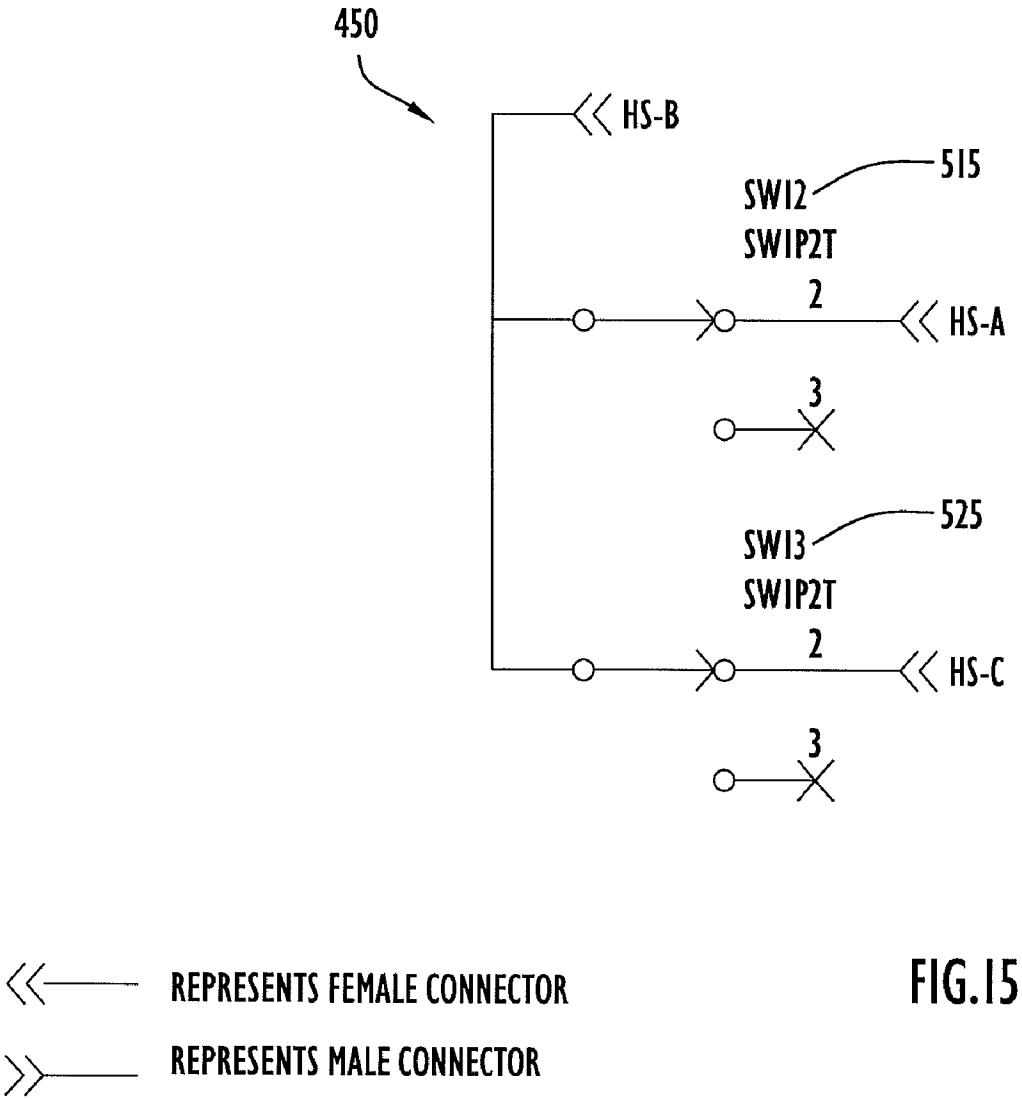
FIG. 15 illustrates a schematic diagram of an example of an electronic sensor configuration for use with the swinging target of FIGS. 14A–C.

FIG. 15 illustrates a schematic diagram of an example of an electronic sensor configuration for the swinging target of the goal 520 according to an embodiment of the present invention. As shown, the goal sensor 505 includes a first switch 515 (SW12) and a second switch 525 (SW13). The switches 515, 525 may be successively closed by as the target rod 575 rotates backward. Consequently, when a sports implement contacts the bull's eye 570 of the target 560 with sufficient force, the switches 515, 525 are closed. When the switches 515, 525 are both closed in the proper order, a "target hit" indicating signal is generated and sent to the control unit. The control unit may then generate an appropriate response (music, score tracking, etc.).

Figure 16:
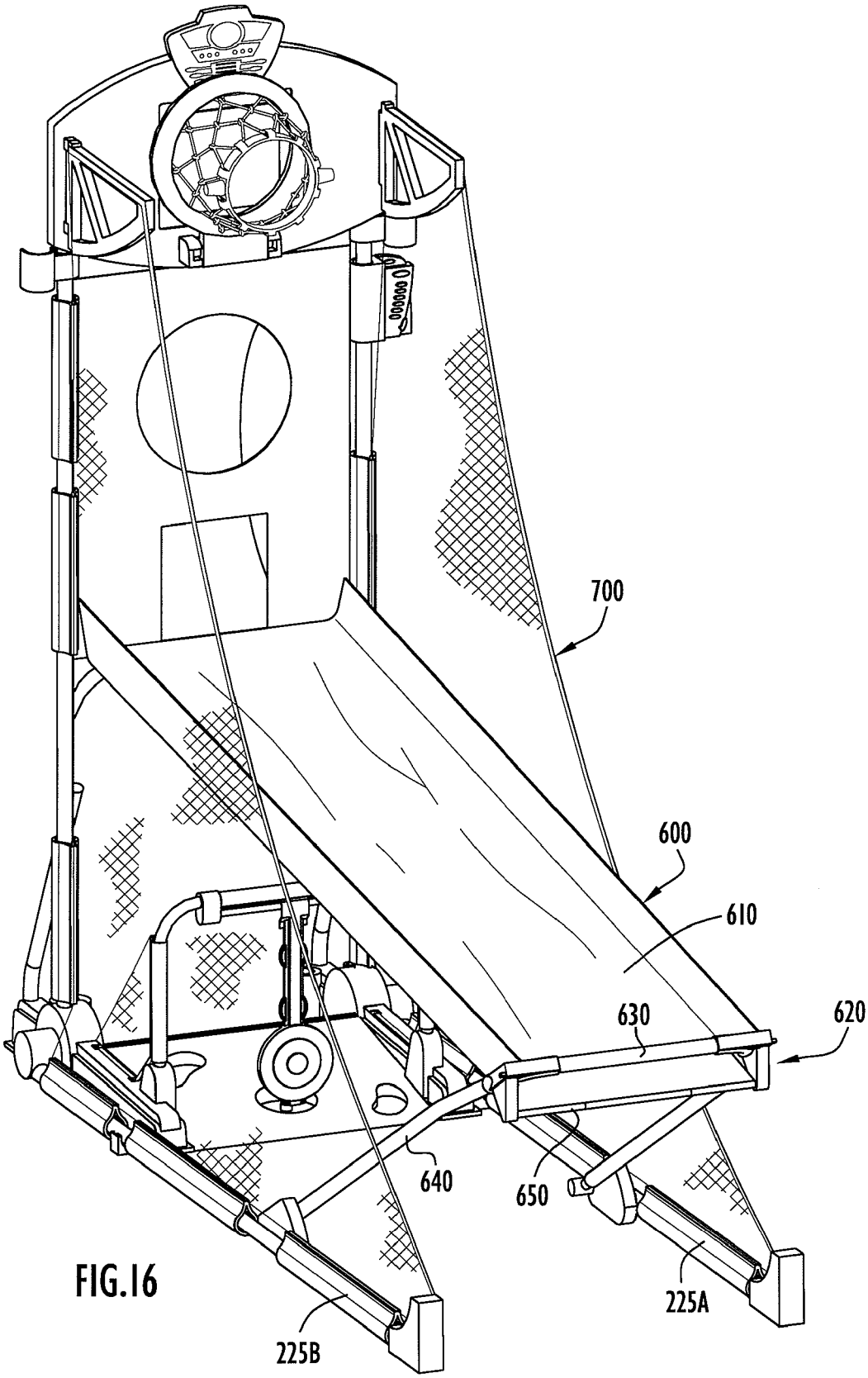
FIG. 16 illustrates a perspective view of the return portion of the apparatus of FIG. 1.

The sports implement/ball return portion 600 of the multi-sport, game apparatus 10 of the present invention includes a structure configured to direct a thrown or shot sports implement back to a user from the basketball portion 300, the first target portion 400, or both. Preferably, the sports implement/ball return portion 600 includes a reconfigurable structure adapted to return a basketball after it is shot by a user toward the basketball portion 300, as well as to return a first sports implement (e.g. a baseball or football) thrown by a user toward the first target portion 400. FIG. 16 illustrates a perspective view of the sports implement/ball return portion 600 of the apparatus 10 of FIG. 1. In the illustrated embodiment, the sports implement/ball return portion 600 includes a chute 610 and a handle structure 620. The chute 610 defines a declined passageway for the sports implements. The chute 610 may comprise a durable, foldable material such as woven and non-woven fabrics (e.g., canvas or polyester). One end of the chute 610 may connect to the vertical supports 210, below the first target portion 400 and above the second target portion 500. The walls of the chute 610 may further connect to the sidewalls 700 of the apparatus 10. The method for connecting the walls of the chute 610 to the sidewalls 700 is not limited, and may include hook and loop fasteners.

Another end of the chute 610 may be connected to the handle structure 620. The handle structure 620 may comprise a handlebar 630 and a pivoting chute support structure 640. The handlebar 630 may include a pair of upper and lower bars spaced in parallel. The handlebar 630 may be adapted to serve as a stop mechanism for the sports implements, preventing their rolling off the end of the chute 610. The upper bar of the handlebar 630 may also serve as a gripping member to assist a user in manipulating the chute (e.g., to deploy or fold the chute, as discussed in greater detail below). The lower bar of the handlebar 630 may further provide a connection point for the chute 610. The method of connecting the chute 610 to the handlebar 630 is not limited. By way of example, the chute 610 may be removably connected to the handlebar 630 via one or more resilient C-shaped clamps 650.

The chute support structure 640 may be adapted to support the chute 610, as well as to convert the chute 610 from a deployed configuration to a folded configuration. In the embodiment of FIG. 16, the chute support structure 640 includes a pair of chute bars extending downward from the left and right ends of the handlebar 630 to a position proximate the center of a corresponding retention member 225A, 225B. The bars of the support structure 640 may be pivotally connected to the retention members 225A, 225B to enable the rotation of the handle structure in a generally arcuate pattern with respect to the supporting surface.

Figure 17A:
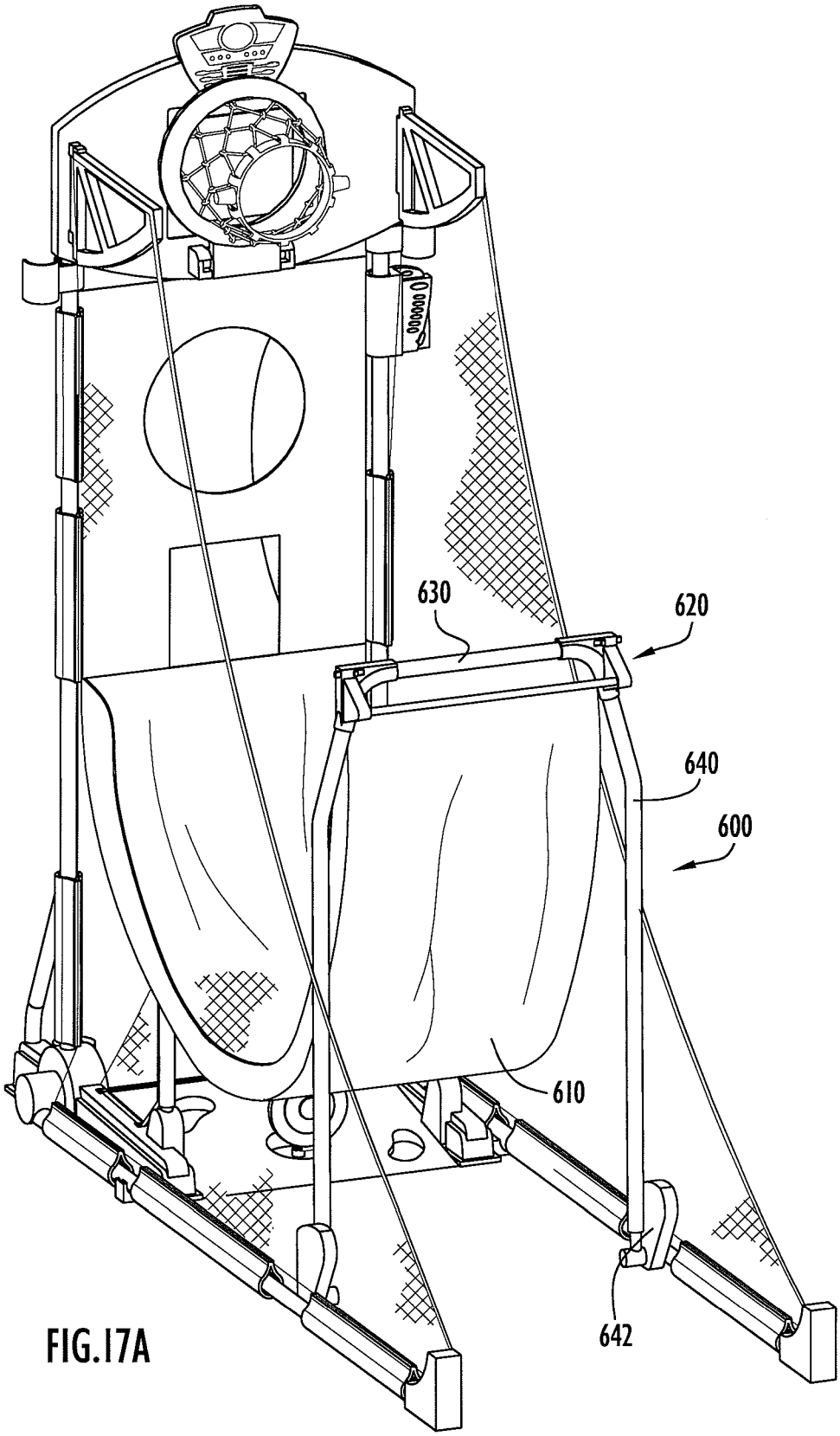
FIGS. 17A, 17B, and 18 illustrate perspective views of the reconfiguration of the return portion of the apparatus of FIG. 1.
Figure 17B:
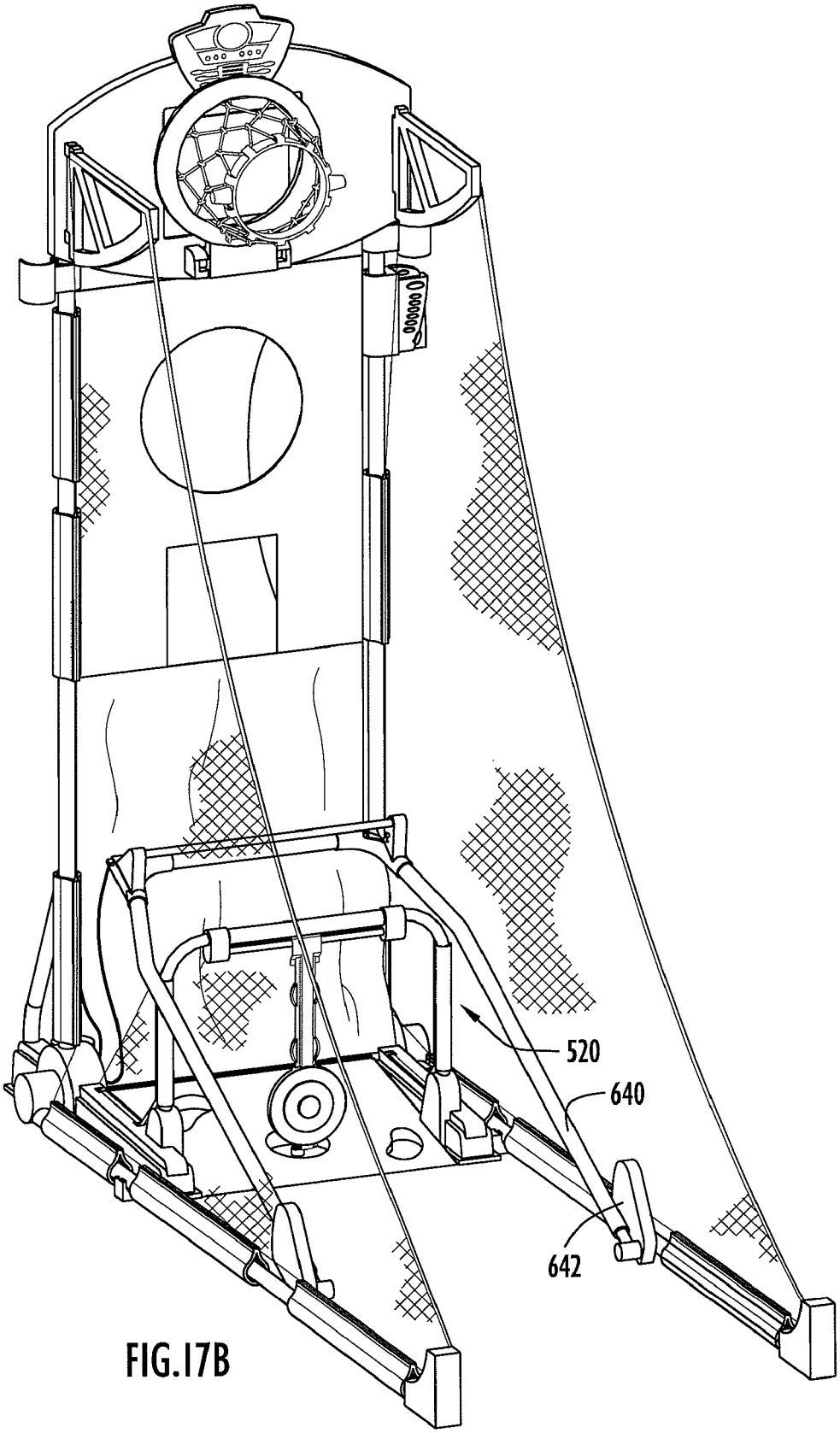
Figure 18:
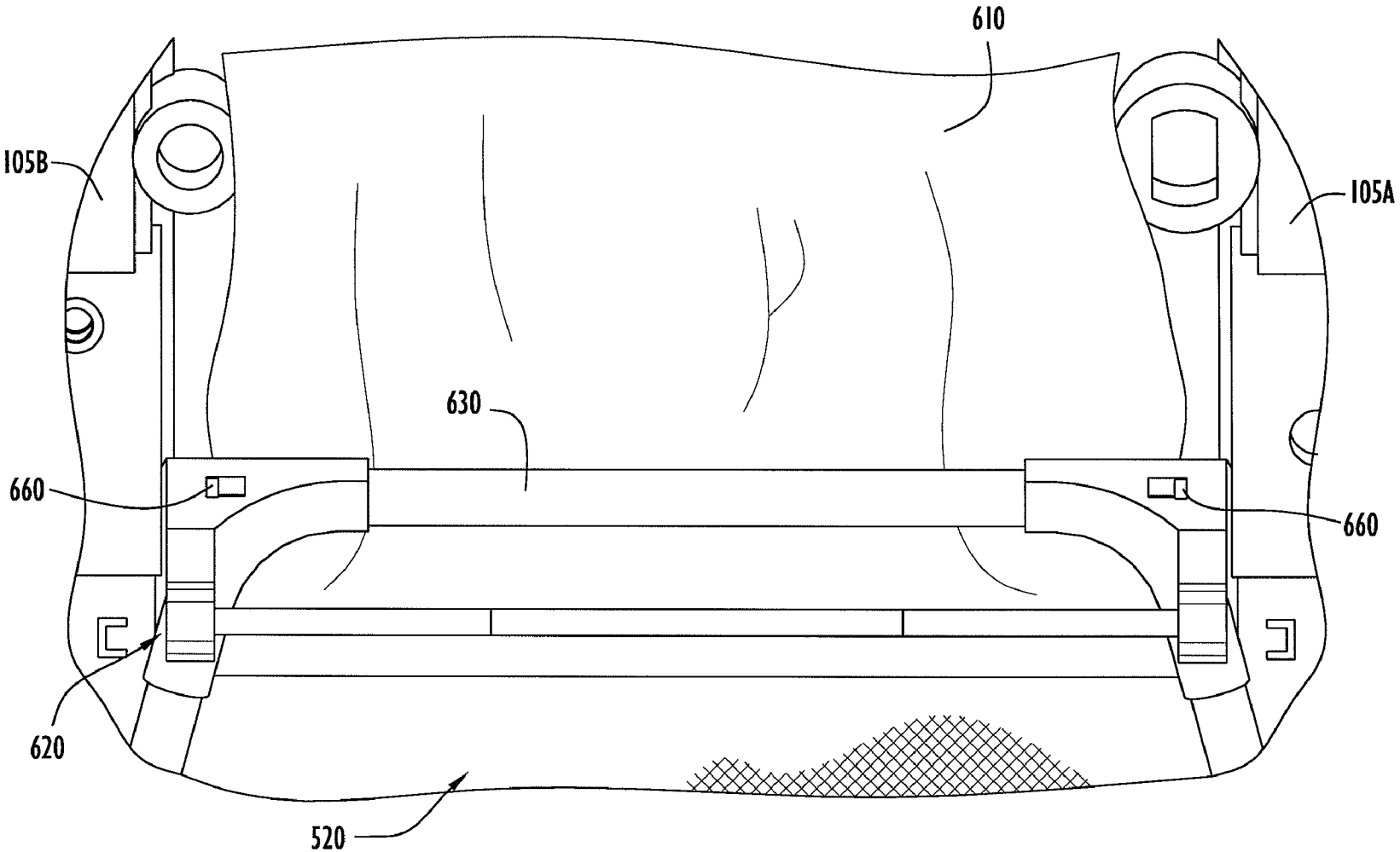

In operation, the sports implement/ball return portion 600 may be pivoted from a deployed configuration (as shown in FIG. 16) to a folded/compacted configuration. FIGS. 17A and 17B illustrate perspective views of the folding of the sports implement/ball return portion 600. Initially, the sports implement/ball return portion 600 begins in its deployed (extended) position as illustrated in FIG. 16. From the deployed position, the chute support structure 640 may be rotated about pivot points 642, toward the vertical supports 210. As shown in FIG. 17A, the rotation of the chute support structure 640 about the pivot points 642 may continue until the bars of the structure 640 obtain a substantially vertical orientation with respect to the supporting surface. Referring next to FIG. 17B, the support structure 640 may then continue to be rotated about the pivot points 642 (downward) until it engages the base 100. That is, the handle structure 620 may travel over the goal 520, with the upper bar of the handlebar 630 urged into slots located on each of the base members 105A, 105B. FIG. 18 illustrates the connection of the handlebar 630 to the base members 105A, 105B. Spring biased tabs within the handlebar 630 (not shown) may engage apertures positioned within the slots of the base members 105A, 105B (also not shown) to secure the handlebar 630 to the base members 105A, 105B. The fabric of the chute 610 (now in a slackened/folded condition), moreover, can be manually positioned behind the goal 520, away from the second target portion 500.

To remove the handlebar 630 from the base members 105A, 105B, release buttons 660 may be engaged. To convert the sports implement/ball return portion 600 from its folded configuration into its deployed configuration, the above process is reversed, with the support structure 640 being pivoted initially upward (and away from the vertical supports 210) about the pivot points 642, then downward.

The expanding of the sports implement/ball return portion 600 ceases when the chute 610 becomes taught. In addition, a stop mechanism may be provided proximate the pivot points 642 of the support structure 640 to the retention members 225A, 225B (not shown).

The sidewalls 700 include a structure capable of maintaining the sports implements (baseball, basketball, soccer ball, etc.) in proximity to the basketball portion 300, the first target portion 400, and/or the second target portion 500. Referring back to FIGS. 1 and 3, the sidewalls 700 may be configured to extend (at least partially) along the sides of the sports implement/ball return portion 600. By way of example, the sidewalls 700 may include netting (comprising, e.g., fabric mesh) that attaches to and the vertical 210 and repositionable 220 supports. The sidewalls 700 may further be connected to the backboard 320 via sidewall brackets 710 (not referenced in FIG. 1, shown in FIGS. 23A and 24). The sidewall bracket 710 may be hinged to the outer (left and right) edges of the backboard 320 such that the sidewall brackets 710 pivot horizontally (about a vertical axis), toward and away from the basket 310. With this configuration, the sidewall brackets 710 are reconfigurable, and can be folded from a deployed position to a storage position.

The game apparatus 10 may further include an electronics system configured to generate, track, and display game conditions. In the embodiment illustrated in FIG. 1, the apparatus 10 may include a display device 800 and a switch housing or box 900. The display unit 800 and/or the switch housing 900 may be operably connected to any of the sensors 350, 450, 505, 585 located in one or more of the basketball portion 300, the first target portion 400, and the second target portion 500. In addition, the display device 800 and/or the switch housing 900 may be operably connected to one or more sensory output generating devices such as speakers.

Figure 19:
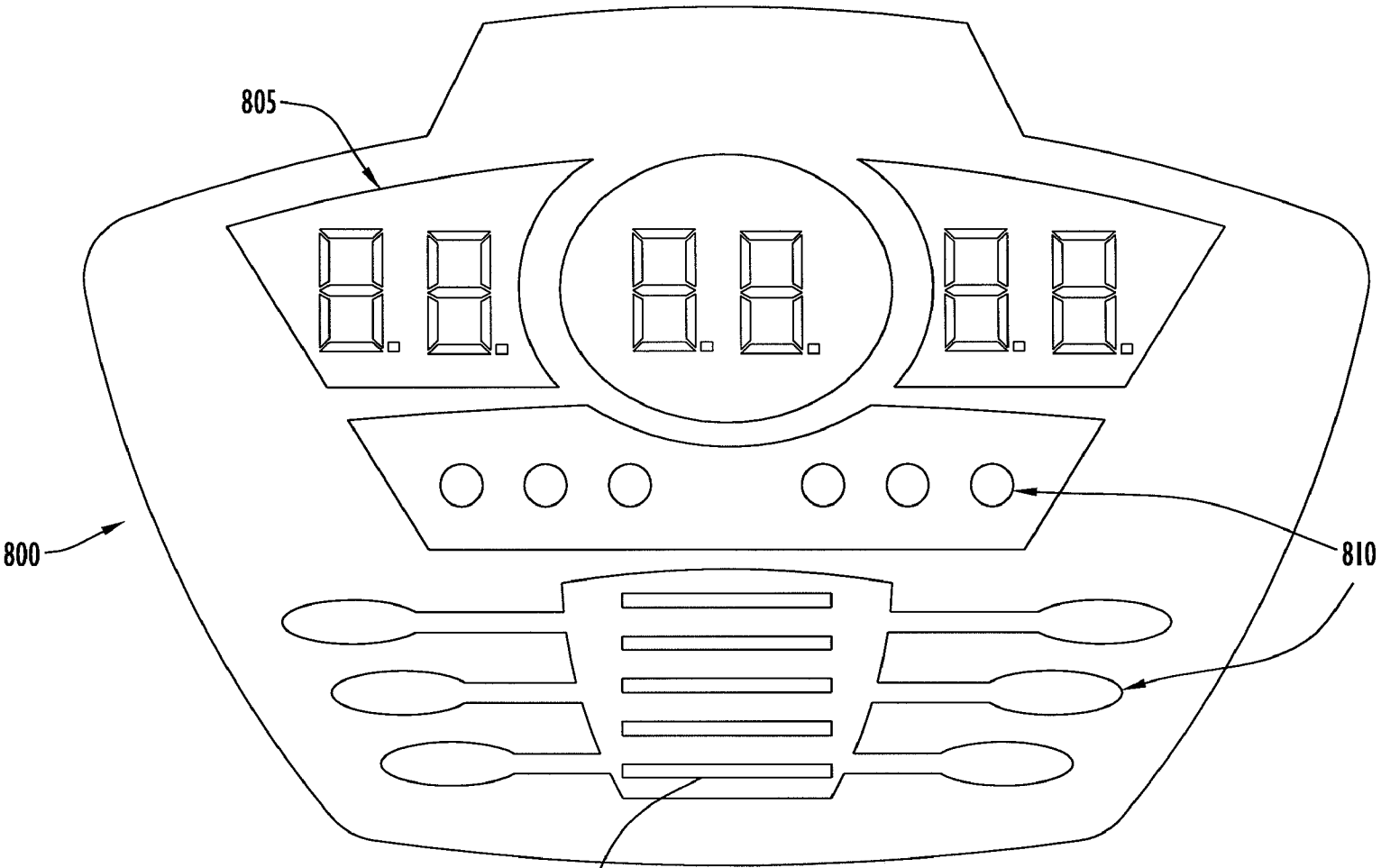
FIG. 19 illustrates a perspective view of a display device for use with the apparatus of FIG. 1 according to an embodiment of the present invention.

The display device 800 of the multi-sport, game apparatus 10 of the present invention comprises a housing adapted to contain electronic sensory output generating devices and to display game information. FIG. 19 illustrates a perspective view of a display device 800 according to an embodiment of the invention. As shown, the display device 800 includes an upper, numeric display section 805; a lower, indicator light section 810; and a centralized speaker housing section 815. The numeric display section 805 may be operable to display number values associated with a sport such as hockey, football, soccer, golf, baseball, and basketball. For example, the numeric display section 805 may display values relating to the time remaining in a contest, the game score, etc. The type of display is not limited to that which is disclosed herein. By way of example, the numeric display section 805 may include a six-digit LED display, wherein each digit comprises seven-segments that are selectively illuminated to generate a desired number.

The indicator light section 810 may be configured to selectively illuminate portions of the display device 800. By way of example, the indicator light section 810 may comprise one or more light-emitting elements including, but not limited to, light emitting diodes (LEDs) and grain of wheat bulbs (GOWs). The indicator light section 810 may be used to indicate game conditions. Specifically, the LEDs and GOWs may be configured to be associated with indicia located on the housing of the display device 800 to relate to game information such as balls, strikes, yards to go, strike-outs, attempts, pitches, downs, etc. The display device 800 may further include a speaker housing section 815 configured to cover a speaker that is used to generate verbal and nonverbal output (e.g., music and sound effects).

Figure 20A:
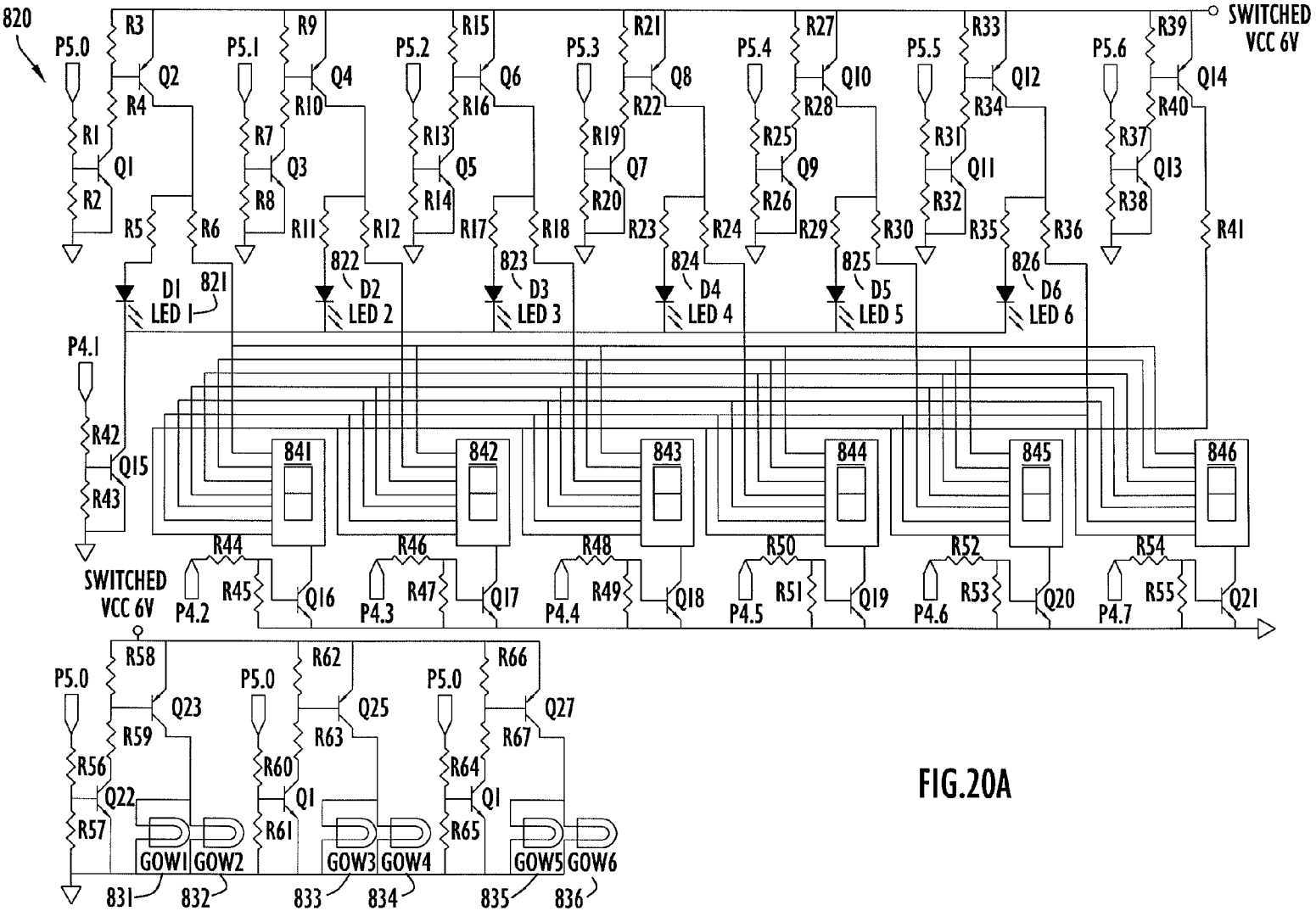
FIGS. 20A and 20B illustrate schematic diagrams of the two portions of the electronics configuration for the display device of FIG. 19 according to an embodiment of the present invention.
Figure 20B:
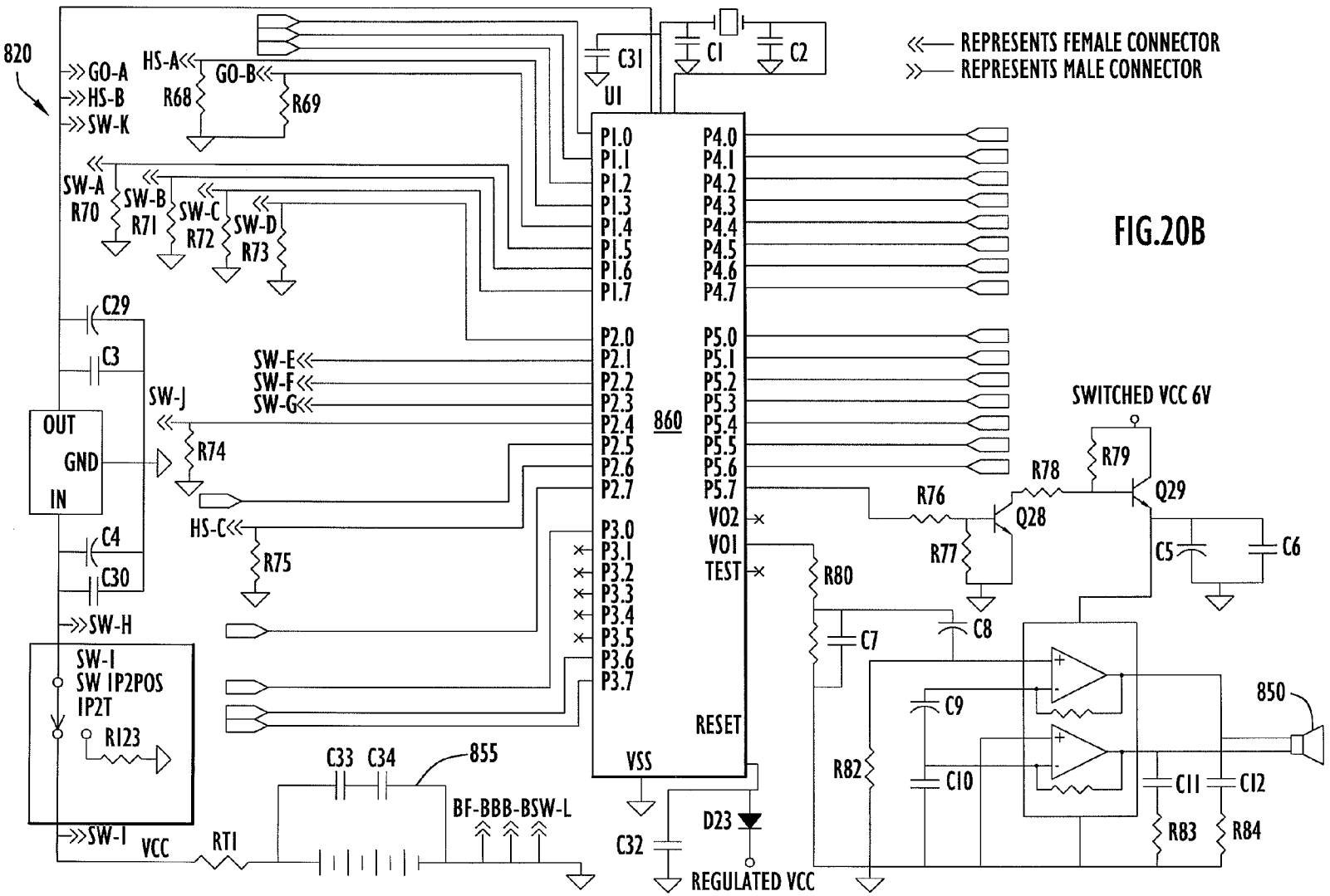

FIGS. 20A and 20B illustrate schematic diagrams of the two portions of the electronics configuration for the display device 800 in accordance with an embodiment of the present invention. Note that the two portions of the electronics configuration for the display device 800 shown in FIGS. 20A and 20B are connected together via standard wiring techniques. The electronics assembly 820 may include one or more sensory output generating devices (e.g., light sources, motors, and speakers) that are engaged and disengaged by one of more switches, as controlled by a control unit. In the embodiment of FIGS. 20A and 20B, the electronics assembly 820 may include: six light emitting diodes (LEDs) 821 (LED 1), 822 (LED2), 823 (LED3), 824 (LED4), 825 (LED5), and 826 (LED 6); six grain of wheat bulbs (GOWs) 831 (GOW1), 832 (GOW2), 833 (GOW3), 834, (GOW4), 835 (GOW5), and 836 (GOW6); six digit-LEDs 841, (Digit 1), 842 (Digit 2), 843 (Digit 3), 844 (Digit 4), 845 (Digit 5), and 846 (Digit 6); a speaker 850; a power source 855; and a control unit 860. The type of LED is not limited, and may include colored and white LEDs. By way of specific example, 5 mm superbright red LEDs may be used. The type of GOW used in the present invention is not specifically limited herein. By way of specific example, 80 mA clear bulbs may be used. The type of digit LED used in the present invention is not limited herein, and may include colored, white and/or clear segments. By way of specific example, common cathode, red ultrabright segments may be used (sold under the trade name WNDC1100RUB-DI, available from Waitrony Co., Ltd., China.

The type of power source 855 is not limited, and may include direct and alternating current sources. By way of specific example, four "C" batteries may be used. The control unit 860 may be operably coupled to each of the speaker 850, the power source 855, the LEDs 821–826, the GOWs 831–836, and the digit LEDs 841–846 (e.g., via a ribbon cable). The control unit 860 may comprise, but is not limited to, microcontrollers, microprocessors, and integrated circuits.

The control unit 860 may be configured to recognize signals generated by the various sensors/switches and control the operational output of the multi-sport, game apparatus 10 (i.e., of the sensory output generating devices). For example, the control unit 860 may activate the light sources 821–826, 831–836, 841–846 and the speaker 850 to generate electronic sensory stimulating output such as audio and visual output (e.g., sound effects, verbal messages, music, motion, and light patterns).

Figure 21:
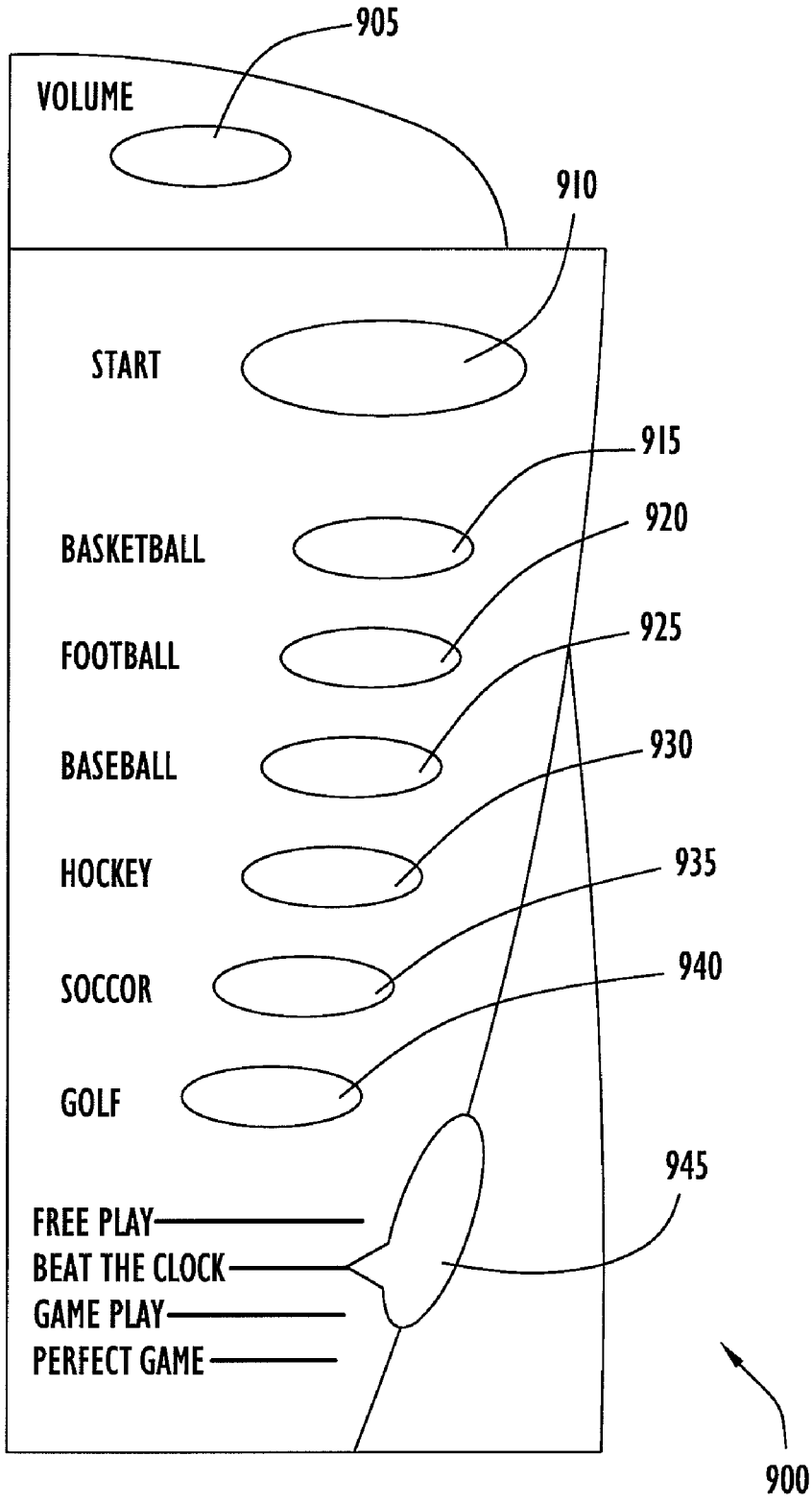
FIG. 21 illustrates a perspective view of a switch housing for use with the apparatus of FIG. 1 according to an embodiment of the present invention.

The switch housing 900 may include one or more switches operably connected to a control unit. FIG. 21 illustrates a perspective view of a switch housing 900 according to an embodiment of the present invention. As shown in FIG. 21, the switch housing 900 may include nine switches 905, 910, 915, 920, 925, 930, 935, 940, and 945. The switch housing 900 also includes a power switch (on/off) on the rear side of the switch housing 900 (not shown). Each switch 905, 910, 915, 920, 925, 930, 935, 940, 945 may comprise, but is not limited to, a mechanical switch (pressure sensitive, contact, push, pivot, and slide), an electrical switch, a magnetic switch, an optical switch, etc. The number of switches, moreover, is not limited to that illustrated herein. Furthermore, the switch housing 900 may further include other electronic components.

Figure 22:
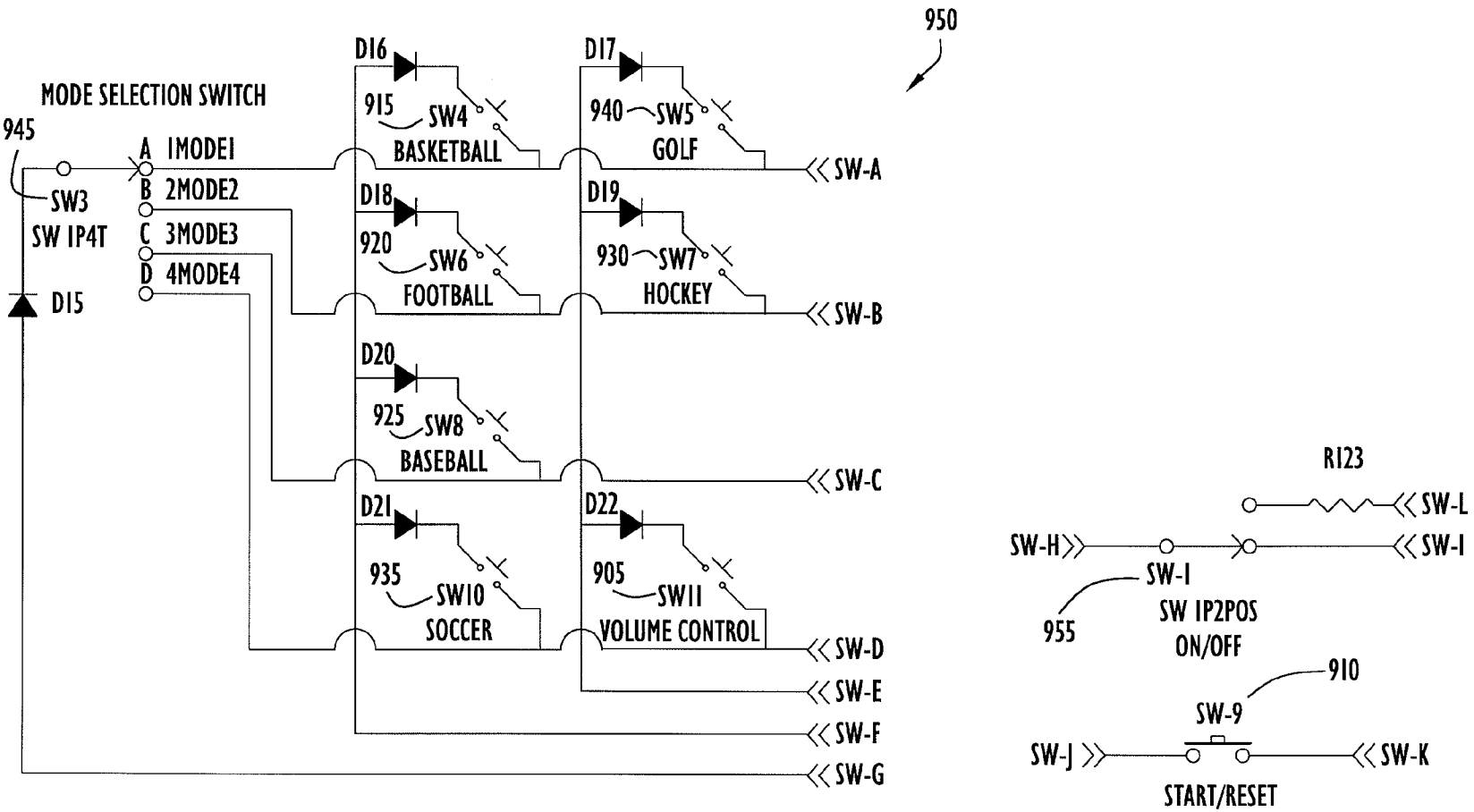
FIG. 22 illustrates a schematic diagram of an electronic assembly associated with the switch housing of FIG. 21 according to an embodiment of the present invention.

FIG. 22 illustrates a schematic diagram of an electronic assembly 950 associated with the switch housing 900. In the embodiment shown in FIG. 22, the electronics assembly 950 may include ten switches 905 (SW11), 910 (SW9), 915 (SW4), 920 (SW6), 925 (SW8), 930 (SW7), 935 (SW10), 940 (SW5), 945 (SW3) having positions A, B, C, and D, and 955 (SW1). Switches 905 (SW11), 910 (SW9), 915 (SW4), 920 (SW6), 925 (SW8), 930 (SW7), 935 (SW10), 940 (SW5), and 945 may each correspond to the switches of the switch housing 900 as illustrated in FIG. 21. Specifically, switch 905 may be used to indicate the corresponding switch 905 on the switch housing has been engaged (to control the volume of the output generated by the speaker). Switch 910 may be used to indicate the corresponding switch 910 on the switch box has been engaged (the START/STOP switch, to initiate or terminate game play). Switches 915, 920, 925, 930, 935, and 940 may be used to indicate the corresponding switches on the switch box 915 (basketball), 920 (football), 925 (baseball), 930 (hockey), 935 (soccer), and 940 (golf) have been engaged (to select a game mode and alter the output of the apparatus 10 in accordance with the game selected). Similarly, switch 945 may be used to indicate the position of the corresponding slide switch 945 on the switch housing 900 (to alter the mode of the game, creating various play patterns for the selected game). Finally, switch 955 may be used to indicate that switch SW1 has been engaged (to provide or discontinue power to the electronics assembly 950).

The control unit 860 is capable of controlling the primary and secondary electronic modes of the toy. The primary electronic modes may designate a particular sport, with electronic output based upon that sport (e.g., scoring rules, game parameters, and sound effects). By way of specific example, the primary electronic modes may include basketball, football, baseball, hockey, soccer, and golf. In addition, the control unit 860 may generate output based on the secondary electronic mode of the toy. The secondary electronic modes may create game play situations. By way of specific example, secondary electronic modes may include a free play mode, a beat the clock mode, a game play mode, and a perfect score mode. For example, the free play mode may include electronic feedback that rewards a successful score with sound effects and speech (e.g., "good shot!"), as well as keeps a running total of points scored. In the beat the clock mode, the control unit 860 may create a scenario to see how many points a user can score in a certain amount of time (tracking, e.g., the time elapsed, the points scored, and/or the passes completed). In the game play mode, the control unit 860 may generate a set of circumstances for a given sport that a player must overcome to win a game or to accomplish a certain task (tracking, e.g., the time, the points scored, and/or the passes completed). Finally, in the perfect game mode, the control unit 860 may create a play pattern challenging a user to be "perfect" by requiring the user to complete a predetermined number of scores in a row to win (if any shots/passes are missed at any time along the way, the user must restart).

Figure 23A:
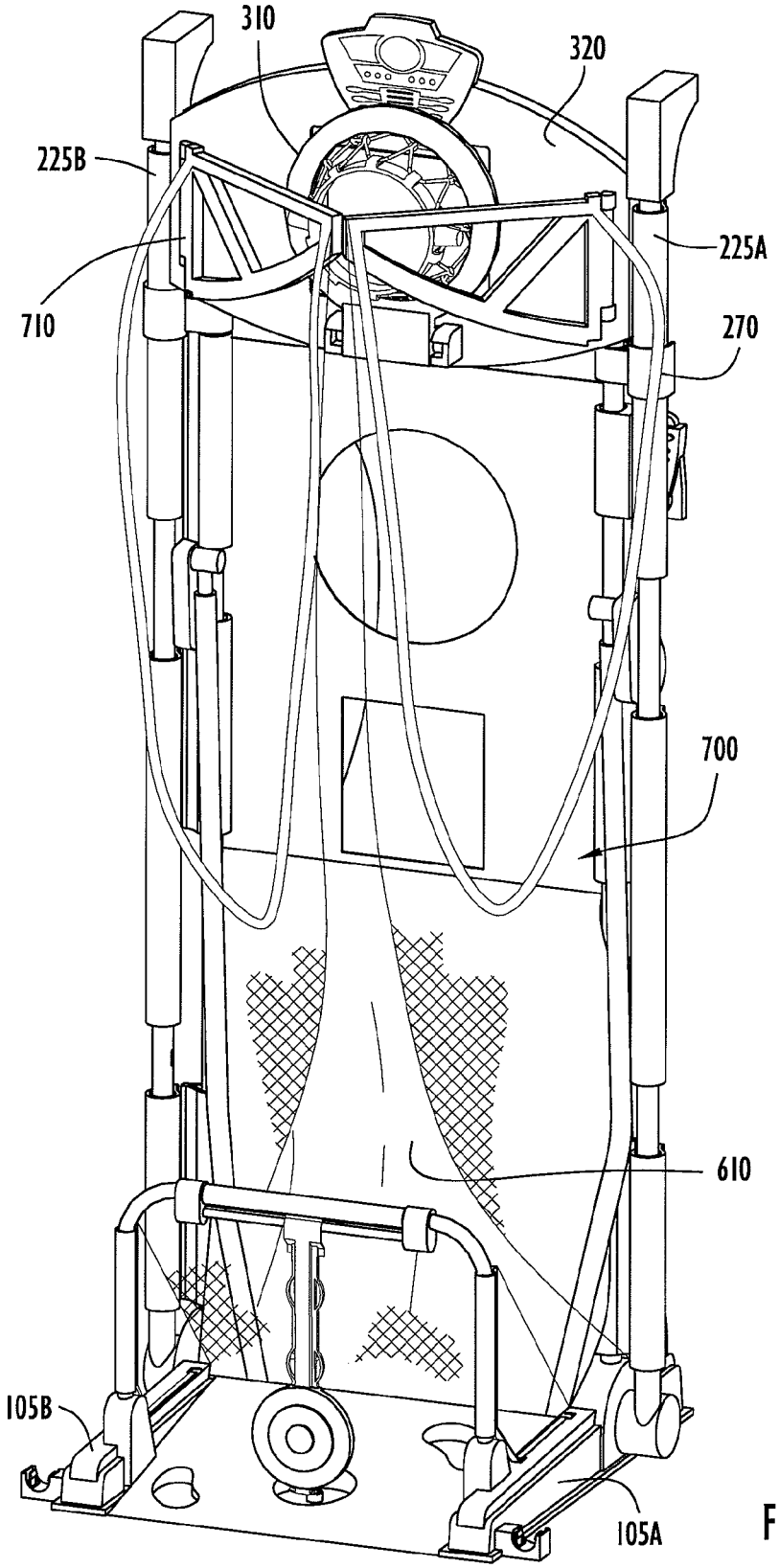
FIGS. 23A, 23B, 24, 25, 26, 27, and 28 illustrate the multiple primary and secondary physical configurations of the multi-sport, game apparatus of FIG. 1.
Figure 23B:
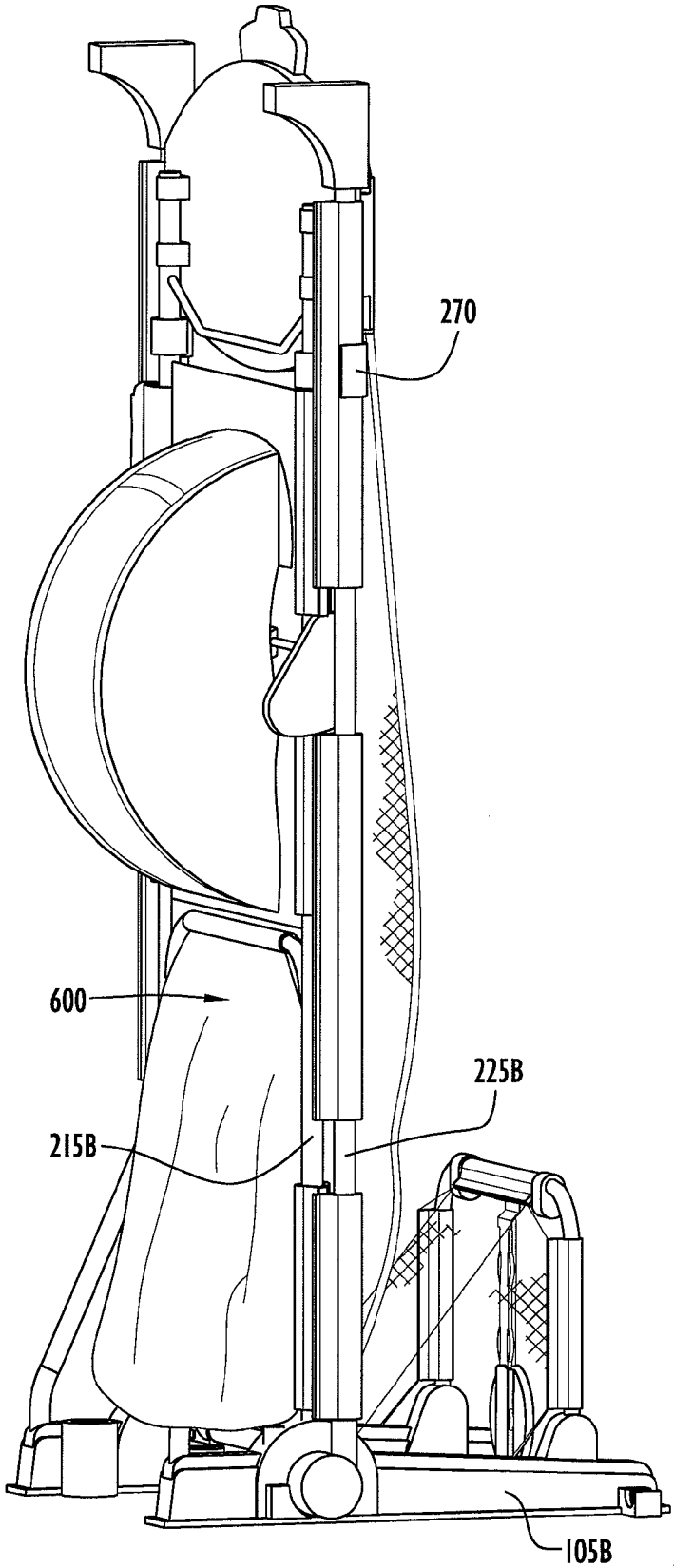

The above-disclosed game apparatus 10 provides a reconfigurable multi-sport, game apparatus with multiple primary configurations, namely, a deployed configuration and a storage configuration. In addition, the deployed figuration may include multiple secondary configurations to alter the physical gaming capabilities of the apparatus. FIGS. 23A, 23B, 24, 25, 26, 27, and 28 illustrate the multiple primary and secondary physical configurations of the multi-sport, game apparatus 10 of the present invention. Specifically, FIGS. 23A and 23B illustrate the storage mode configuration of the multi-sport, game apparatus 10. As illustrated, the retention members 225A, 225B are positioned upward such that they are positioned parallel to the vertical supports 210 (posts 215A, 215B). The retention members 225A, 225B, moreover, are secured within the clamps 270, while the basket 310 is pivoted upward such that it contacts the backboard 320. The sports implement/ball return portion 600 is in its folded configuration, with the handlebar 630 of the chute support structure 640 locked into the base members 105A, 105B. Finally, the sidewalls 700 are folded inward (via the pivoting sidewall brackets 710) such that the sidewall brackets 710 are positioned over the folded basket 310. As shown, in the storage configuration, the multi-sport, game apparatus 10 is freestanding.

Figure 24:
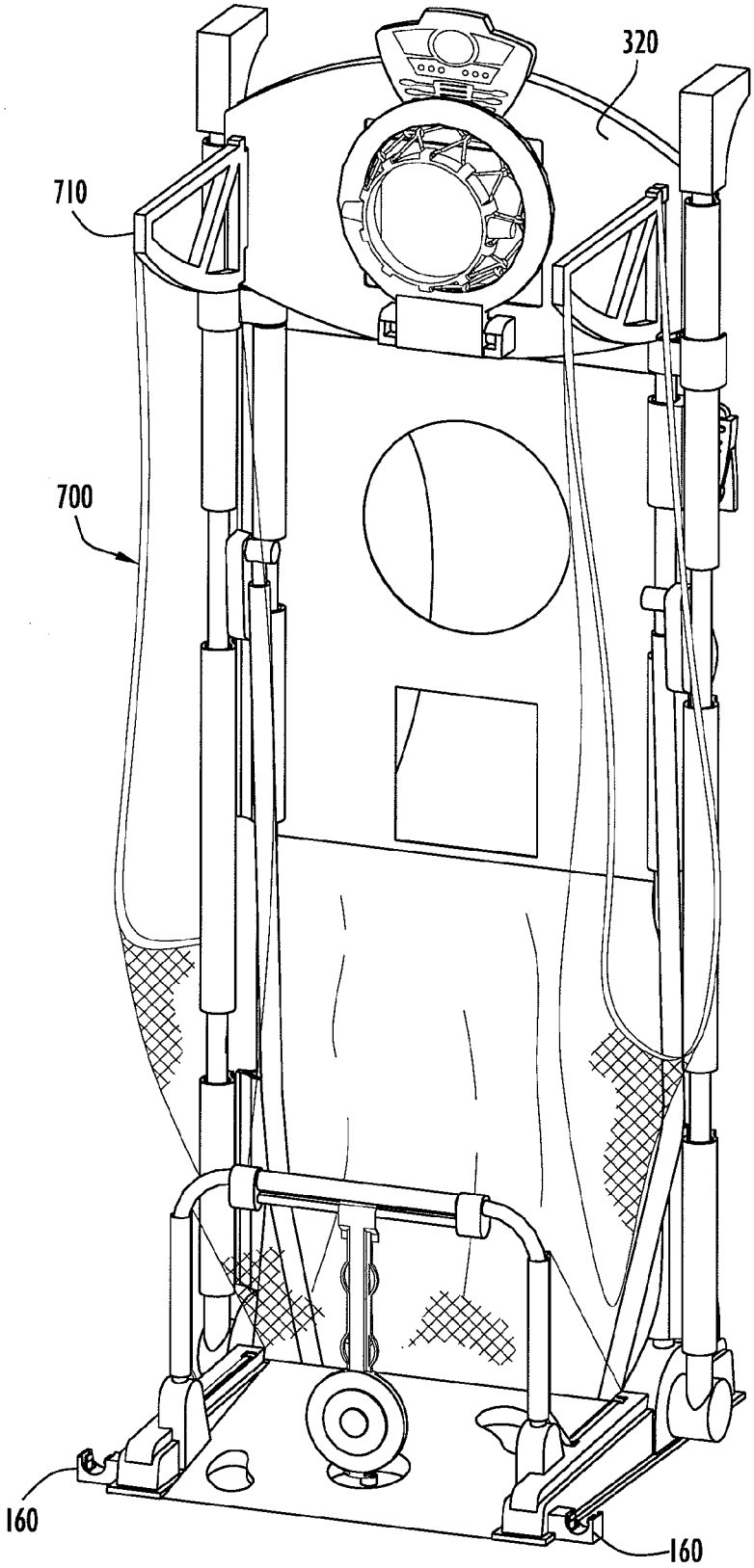
Figure 25:
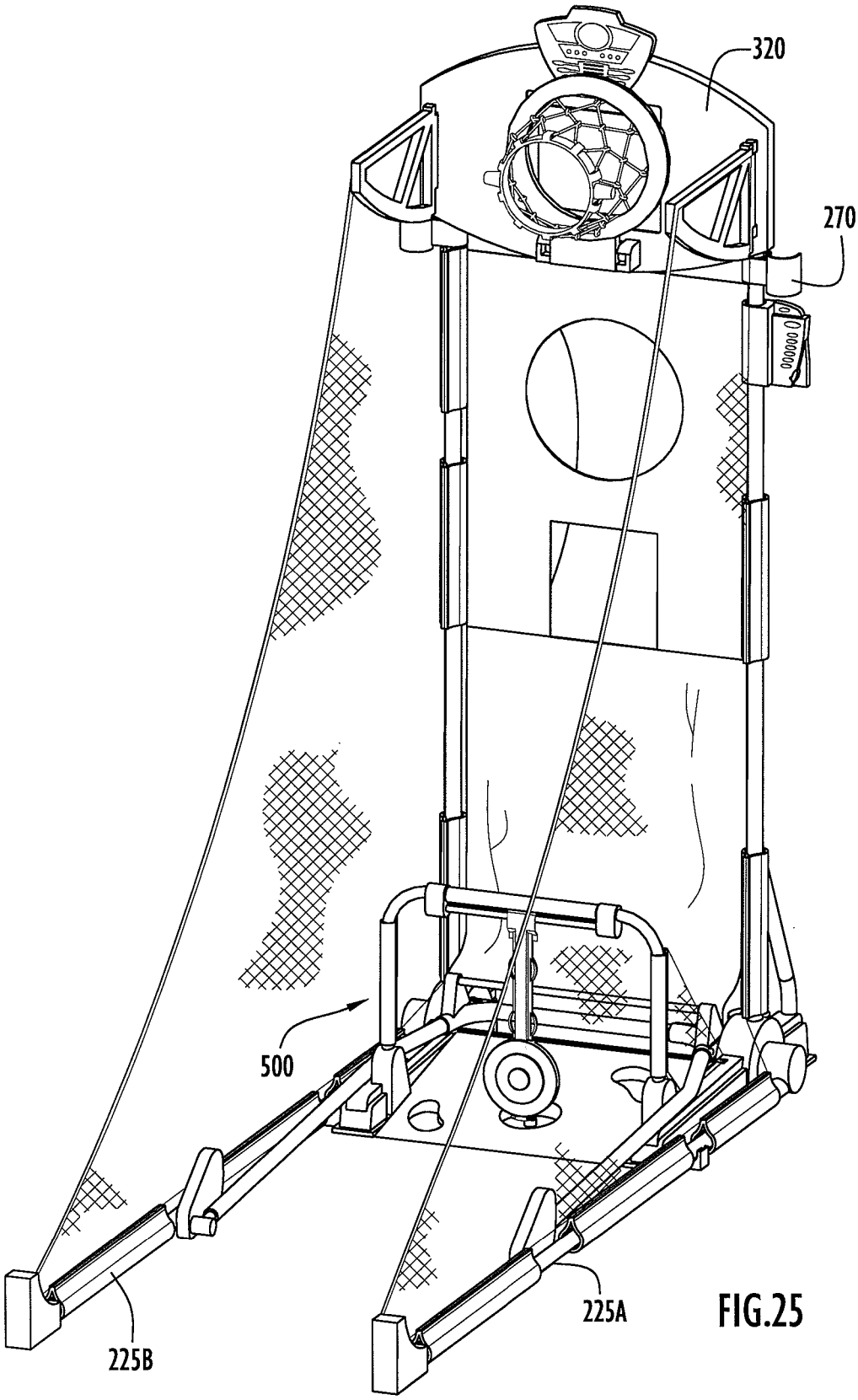
Figure 26:
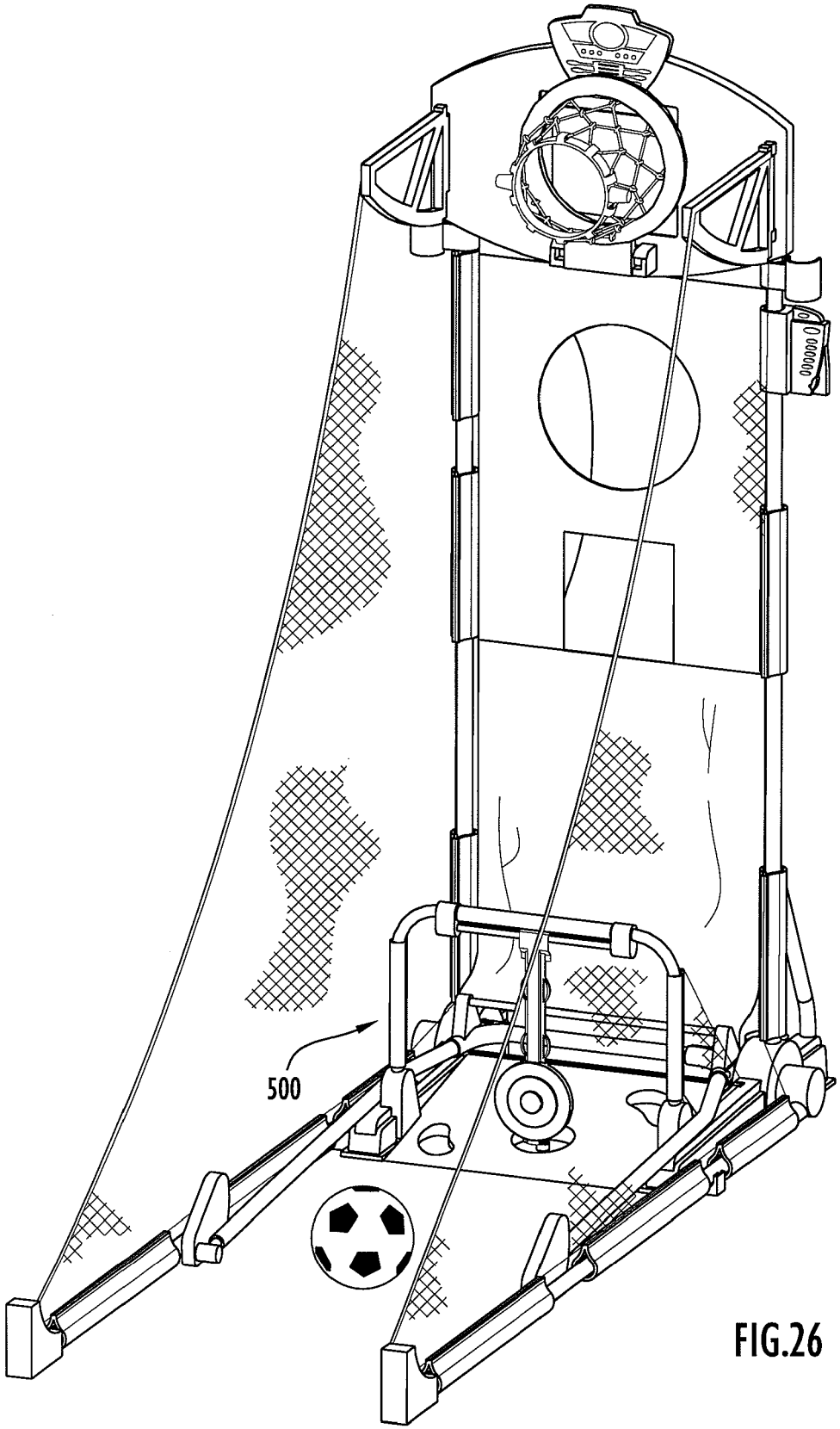
Figure 27:
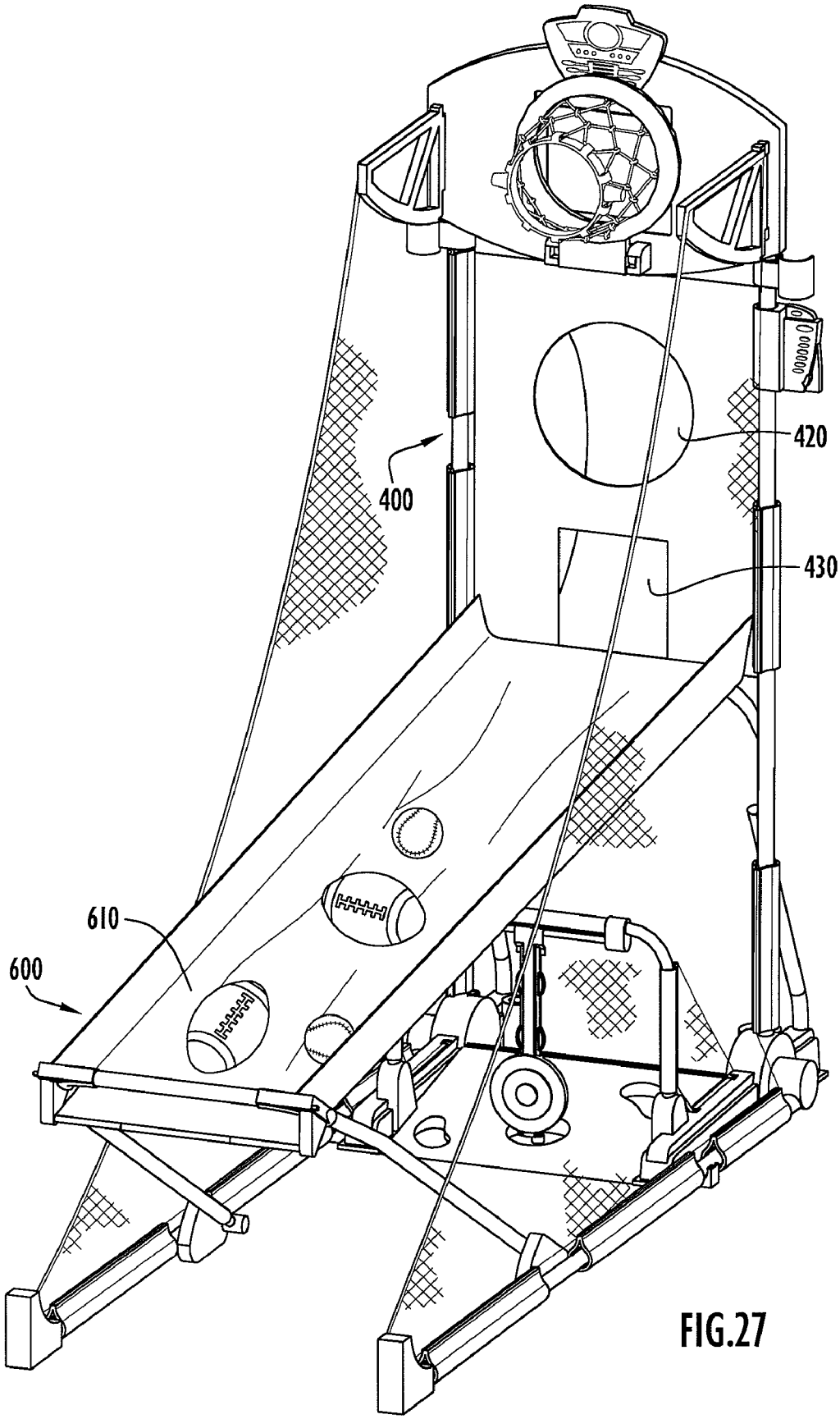
Figure 28:
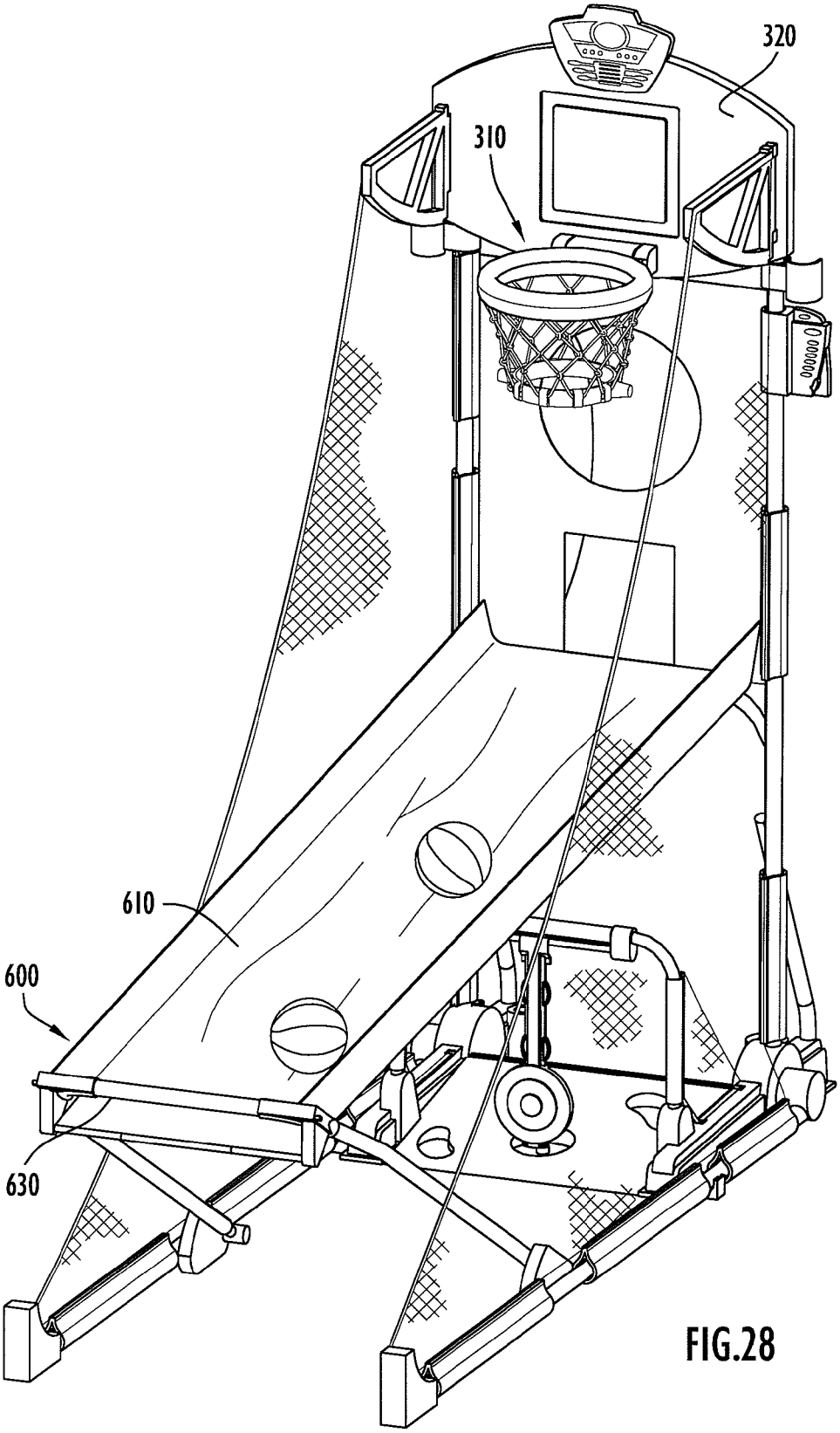

To rearrange the multi-sport, game apparatus 10 from its stored configuration to a first, propelled sport implement configuration (also called a floor mode), the sidewall brackets 710 are pivoted outward until they are oriented perpendicular to the backboard 320. This step of the reconfiguration process is illustrated in FIG. 24. The retention members 225A, 225B of the repositionable support 220 are removed from their respective clamps 270. The retention members 225A, 225B are then rotated downward (away from the front of the backboard 320) and onto the supporting surface. The retention members 225A, 225B may be secured to the base members 105A, 105B via the base clips 160. This configuration, illustrated in FIG. 25, exposes the second target portion 500 to a user or player; consequently, the user is capable of playing sports such as hockey, soccer, and golf (i.e., sports games involving propelled sports elements, further illustrated in FIG. 26).

To place the apparatus in its second, thrown-sports-element configuration (also called an upright mode) the sports implement/ball return portion 600 is unfolded (as described above). Briefly, the handlebar 630 is removed from the slots within the base members 105A, 105B (not shown) and rotated upward, away from the front surface of the backboard 320. The rotation continues, with the handlebar 630 pivoting downward until the chute 610 becomes taught, preventing further rotation of the handle structure. Hook and loop fasteners may be used to secure the sides of the chute 610 to the sidewalls 700. This configuration, illustrated in FIG. 27, enables the user or player to utilize the sports implement/ball return portion 600 with the first target area 400; consequently the user is capable of playing sports games such as football and baseball (i.e., sports games involving thrown sports implements, as illustrated). In operation, a user throws a football or a baseball at the first target portion 400 attempting to throw the ball into the entrance 420. If successful, the ball passes through the entrance 420, down the sleeve 440, and out the exit 430. The passage of the ball down the sleeve 440 is sensed by the first target portion sensor. The ball is then deposited onto the chute 610 via the exit 420, travels down the chute 610, and back toward the user.

To position the multi-sport, game apparatus 10 in its third, shot sports implement configuration (also called a basketball mode), the basket 310 is rotated downward, away from the front surface of the backboard 320. This configuration, illustrated in FIG. 28, exposes the basket 310 to the user and enables a user to play sports games such as basketball (i.e., a sports game involving a sports element that is shot by the user). Similar to the upright mode, a user shoots a basketball at the basketball portion 300. As a ball passes through the basket 310, the sensor within the basket 310 detects the passage. The ball falls onto the chute 610 of the sports implement/ball return portion 600, rolling down toward the handlebar 630 and back to the user. Although not discussed in detail, it is understood that similar game play patterns may be provided for the second target portion (e.g., for soccer, golf, and hockey game play).

Figure 29:
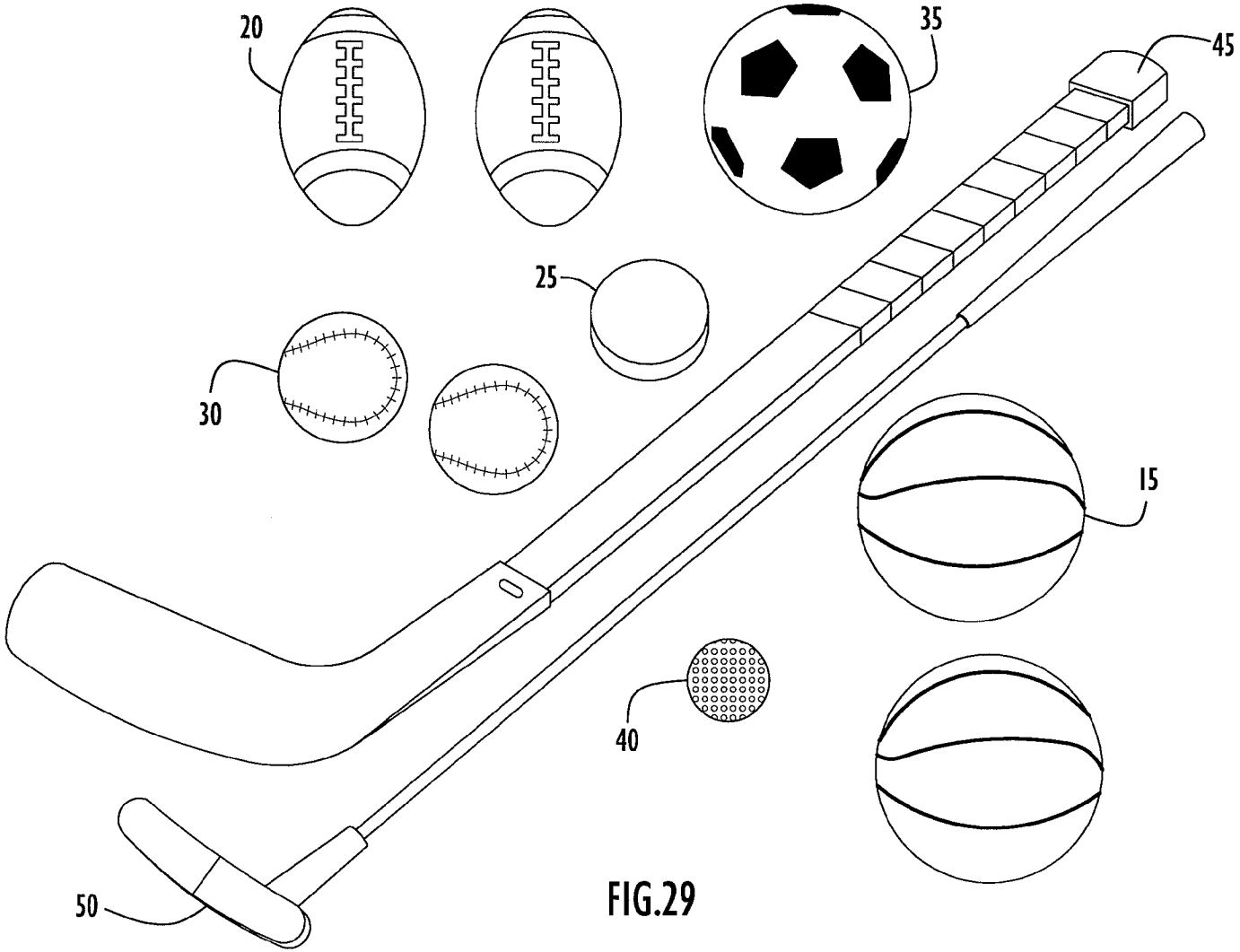
FIG. 29 illustrates the types of sports implements that can be used with the multi-sport, game apparatus of FIG. 1 in accordance with the present invention.

FIG. 29 illustrates the types of sports implements that can be used with the multi-sport, game apparatus 10 of the present invention. Specifically, the sports implements may include a basketball 15, a football 20, a hockey puck 25, a baseball 30, a soccer ball 35, and a golf ball 40. By way of example, the sports implements 15, 20, 25, 30, 35, 40 may comprise rubber, may be made inflatable, may be rotocast, and/or may comprise high- or low-density foam. The composition or type of the sports implements is not limited to those disclosed herein. Accessories may also be used with the apparatus, including but not limited to a hockey stick 45 and a golf club 50 (e.g., a putter). Such accessories may be stored in the storage receptacles 150 in the base members 105A, 105B (see FIG. 2).

With the above configuration, the multi-sport, game apparatus 10 of the present invention may be arranged in any of the aforementioned configurations (stored, deployed, shooting mode, floor mode, or upright mode), allowing a user to engage in multiple sports games using a single apparatus. In operation, a user physically orients the apparatus to the desired sport game configuration. The user then selects the desired primary electronic mode (i.e., one of the sports games that the physical configuration allows), as well as a secondary electronic mode (selecting parameters under which the selected sport will be played). The user then selects the desired sports implement, interacting with any one of the separate target portions (the shot ball portion, the first target portion, or the second target portion) to play the desired game. A user is, moreover, free to alter the physical mode, primary electronic mode, and secondary electronic mode of the game apparatus 10 at any point during game play.

While the invention has been described in detail and with reference to specific embodiments thereof, it will be apparent to one skilled in the art that various changes and modifications can be made therein without departing from the spirit and scope thereof. For example, the sports game apparatus 10 can be of any size and shape. The sports game apparatus 10 need not be sized for use by only children, and can be sized larger for adult use. The material comprising the frame 100 is not limited, and may include tubes comprising metal (e.g., aluminum or steel). The number and type of separate target portions is not limited. The shooting ball portion 300 may include any number of rims or baskets 310. The first 400 and second 500 target portions may include any number of targets, goals, entrances, exits, and cups.

The backing 410 and chute 610 portions may comprise any suitable material such as soft, pliant material fabric. The number, types, and sizes of the sport implements are not limited, and may be sized to accommodate varying age groups. For example, they may include a size smaller or larger than an NCAA football/basketball (men's or women's), baseball, or softball. The propelled sports implement is not limited, and includes other than those discussed above, including a croquet ball, a field hockey ball, a kick ball, etc. The thrown sports implement is not limited, and includes implements other than those discussed above, including a flying disc and/or a lacrosse ball. The propelled and thrown sports implements may be made of any suitable material, including a porous, spongy material to minimize the likelihood of injury. The goal 520, in addition to having a sensor that detects the contact with the bull's eye 570 of the target 560, may also include a sensor operable to detect the presence of a sports implement within the net. For example, the goal posts may include an optical sensor having a transmitter/receiver pair positioned about the mouth of the goal 520. A user may use the apparatus in any desired configuration, and need not deploy the chute 610 to utilize the basketball or first target portions (e.g., if the user does not desire the return feature).

The electronics assemblies may include any combination of sensors, switches, lights, speakers, animated members, motors, and sensory output generating devices. The control unit 860 may produce any combination of audio and visual effects including, but not limited to, animation, lights, and sound (music, speech and sound effects). The output pattern is not limited and includes any pattern of music, lights, and/or sound effects. The electronics system may also include additional switches or sensors to provide additional sensory output activation.

Thus, it is intended that the present invention cover the modifications and variations of this invention that come within the scope of the appended claims and their equivalents. For example, it is to be understood that terms such as "left", "right" "top", "bottom", "front", "rear", "side", "height", "length", "width", "upper", "lower", "interior", "exterior", "inner", "outer" and the like as may be used herein, merely describe points of reference and do not limit the present invention to any particular orientation or configuration.

I claim:

1. A reconfigurable sports game apparatus including a frame to support the reconfigurable sports game apparatus on a supporting surface, the reconfigurable sports game apparatus comprising:

a basketball rim configured to receive a basketball;

a first target portion including an orifice configured to receive a first sports implement thrown by a user of the reconfigurable sports game apparatus; and a second target portion including an orifice configured to receive a second sports implement propelled along the supporting surface by a user of the reconfigurable sports game apparatus, wherein each of the basketball rim, the first target portion, and the second target portion are separate elements and wherein each of the basketball rim, the first target portion, and the second target portion are simultaneously supported on the frame.

2. The reconfigurable sports game apparatus of claim 1 further comprising a return portion configured to return the basketball after it is shot by a user toward the basketball rim and to return the first sports implement after it is thrown by a user toward the first target portion.

3. The reconfigurable sports game apparatus of claim 2, wherein the return portion is configured to be disposed in a folded, non-return position and an extended, return position.

4. The reconfigurable sports game apparatus of claim 1 further comprising at least one repositionable retention member, the at least one repositionable retention member being configured to be disposed in a storage position and a deployed position.

5. The reconfigurable sports game apparatus of claim 4, wherein the at least one repositionable retention member is disposed in the deployed position and maintains the basketball, the first sports implement, and the second sports implement in proximity to the basketball rim, the first target portion, and the second target portion, respectively.

6. The reconfigurable sports game apparatus of claim 1 further comprising a sensor element associated with each of the basketball rim, the first target portion, and the second target portion, wherein the sensor element is operable to detect the presence of the basketball, the first sports implement, and the second sports implement in proximity to the basketball rim, the first target portion, and the second target portion, respectively.

7. The reconfigurable sports game apparatus of claim 6, wherein the sensor element associated with the basketball rim is an optical sensor.

8. The reconfigurable sports game apparatus of claim 6, wherein the sensor element associated with the first target portion is an optical sensor.

9. The reconfigurable sports game apparatus of claim 6, wherein the sensor element associated with the second target portion is a mechanical sensor.

10. The reconfigurable sports game apparatus of claim 1, wherein the first sports implement is a football or a baseball.

11. The reconfigurable sports game apparatus of claim 1, wherein the second sports implement is a soccer ball, a hockey puck, or a hockey ball.

12. The reconfigurable sports game apparatus of claim 1, wherein the second target portion includes a net configured to receive the second sports implement propelled along the supporting surface by a user of the reconfigurable sports game apparatus.

13. The reconfigurable sports game apparatus of claim 1, wherein the second target portion includes an orifice configured to receive the second sports implement propelled along the supporting surface by a user of the reconfigurable sports game apparatus, and wherein the second sports implement is a golf ball.

14. A reconfigurable sports game apparatus including a frame to support the reconfigurable sports game apparatus on a supporting surface, the reconfigurable sports game apparatus comprising:

a basketball rim configured to receive a basketball;

a first target portion including a vertically oriented orifice configured to receive a first sports implement thrown by a user of the reconfigurable sports game apparatus; and a return portion configured to return the basketball to the user after it is shot by a user toward the basketball rim and to return the first sports implement to the user after it is thrown by a user toward the first target portion, wherein the basketball rim, the first target portion, and the return portion are simultaneously supported on the frame.

15. The reconfigurable sports game apparatus of claim 14, wherein the return portion is movable from a folded, non-return position to an extended, return position while coupled to the frame.

16. The reconfigurable sports game apparatus of claim 14 further comprising at least one repositionable retention member, the at least one repositionable retention member being configured to be disposed in a storage position and a deployed position, wherein the at least one repositionable retention member maintains the basketball and the first sports implement in proximity to the basketball rim and the first target portion, respectively.

17. The reconfigurable sports game apparatus of claim 14 further comprising a second target portion configured to receive a second sports implement propelled along the supporting surface by a user of the reconfigurable sports game apparatus, wherein at least the first target portion and the basketball rim are separate elements.

18. The reconfigurable sports game apparatus of claim 17 further comprising a sensor element associated with each of the basketball rim, the first target portion, and the second target portion, wherein the sensor element is operable to detect the presence of the basketball, the first sports implement, and the second sports implement in proximity to the basketball rim, the first target portion, and the second target portion, respectively.

19. The reconfigurable sports game apparatus of claim 18, wherein the sensor elements associated with the basketball rim and the first target portion are optical sensors.

20. The reconfigurable sports game apparatus of claim 18, wherein the sensor element associated with the second target portion is a mechanical sensor.

21. The reconfigurable sports game apparatus of claim 14, wherein the first sports implement is a football or a baseball.

22. The reconfigurable sports game apparatus of claim 17, wherein the second sports implement is a soccer ball, a hockey puck, or a hockey ball.

23. The reconfigurable sports game apparatus of claim 17, wherein the second target portion includes a net configured to receive the second sports implement propelled along the supporting surface by a user of the reconfigurable sports game apparatus.

24. The reconfigurable sports game apparatus of claim 17, wherein the second target portion includes an orifice configured to receive the second sports implement propelled along the supporting surface by a user of the reconfigurable sports game apparatus, and wherein the second sports implement is a golf ball.

25. The reconfigurable sports game apparatus of claim 1, wherein:

the first target portion comprises a panel including the first target portion orifice; and the second target portion orifice comprises at least one of a golf cup and a goal including a net, the at least one of a golf cup and a goal including a net configured to receive the second sports implement propelled along the supporting surface by a user.

26. The reconfigurable sports game apparatus of claim 14, wherein the first target portion comprises a panel including the first target portion orifice for receiving the first sports implement thrown by a user, the first target portion orifice configured to allow passage of the first sports implement thrown by a user therethrough.

* * * * *

UNITED STATES PATENT AND TRADEMARK OFFICE

CERTIFICATE OF CORRECTION

PATENT NO. : 7,247,105 B2
APPLICATION NO. : 11/032221
DATED : July 24, 2007
INVENTOR(S) : Huntsberger It is certified that error appears in the above-identified patent and that said Letters Patent is hereby corrected as shown below:

On the Title Page

Item (56) References Cited -- Please Add the Following

--5,746,669 5/1998 Sinsheimer, et al
6,419,224 7/2002 Tsai--

Signed and Sealed this
Twenty-ninth Day of January, 2013

David J. Kappos

David J. Kappos
*Director of the United States Patent and Trademark Office*